US007662039B2

(12) United States Patent
Matsuno et al.

(10) Patent No.: US 7,662,039 B2
(45) Date of Patent: Feb. 16, 2010

(54) MULTI-PLAYER GAMING MACHINE

(75) Inventors: Masaki Matsuno, Tokyo (JP); Junpei Sato, Tokyo (JP); Hirobumi Toyoda, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 226 days.

(21) Appl. No.: 11/521,608

(22) Filed: Sep. 15, 2006

(65) Prior Publication Data

US 2007/0066387 A1 Mar. 22, 2007

(30) Foreign Application Priority Data

Sep. 16, 2005 (JP) ..... 2005-270854

(51) Int. Cl.
*A63F 9/24* (2006.01)

(52) U.S. Cl. ..... 463/25; 463/16; 463/42

(58) Field of Classification Search ..... 463/9, 463/13, 25, 16, 20, 21, 26, 27, 28, 40, 41
See application file for complete search history.

(56) References Cited

U.S. PATENT DOCUMENTS

| | | | | |
|---|---|---|---|---|
| 4,760,527 | A | 7/1988 | Sidley | |
| 5,636,843 | A | 6/1997 | Roberts | |
| 6,719,629 | B2 * | 4/2004 | Yang | 463/13 |
| 6,921,333 | B2 * | 7/2005 | Taguchi | 463/9 |
| 7,288,024 | B2 * | 10/2007 | Toyoda | 463/13 |
| 2003/0054870 | A1 | 3/2003 | Sato | |
| 2003/0157977 | A1 * | 8/2003 | Thomas et al. | 463/13 |
| 2004/0204235 | A1 * | 10/2004 | Walker et al. | 463/29 |
| 2007/0026936 | A1 * | 2/2007 | Gatto et al. | 463/25 |

FOREIGN PATENT DOCUMENTS

| | | | |
|---|---|---|---|
| EP | 1 371 402 | A | 12/2003 |
| GB | 2 402 349 | A | 12/2004 |
| GB | 2 403 429 | A | 1/2005 |
| JP | 2004-008706 | A | 1/2004 |

* cited by examiner

*Primary Examiner*—James S McClellan
(74) *Attorney, Agent, or Firm*—Arent Fox LLP

(57) ABSTRACT

The present invention provides a multi-player gaming machine that enables players waiting for players now playing a game to end it, to enjoy another game during waiting. The multi-player gaming machine includes a main game section providing a main game which can be played by a plurality of main players at the same time for coins or the like and in which awards based on the bet coins or the like are paid out to the main players in accordance with an outcome of the game, and a sub-game section providing a sub-game in which sub-players bet playing values on the game outcome for the main players and in which awards based on the coins obtained or the like are paid out to the sub-players in accordance with an outcome of the game. The main game section sends main game status information indicating a status of the main game to the sub-game section. The sub-game section determines a bet acceptance period of the sub-game on the basis of the main game status information.

20 Claims, 26 Drawing Sheets

MULTI-PLAYER GAMING MACHINE

This application claims the foreign priority of the Japanese Patent Application No. 2005-270854 filed on Sep. 16, 2005, which is incorporated herein by reference in its entireties.

BACKGROUND OF THE INVENTION

1. Field of the Invention

The present invention relates to a multi-player gaming machine, and more specifically, to a multi-player gaming machine with which a game is played for playing values and which provides a winning player with playing values the amount of which corresponds to the bet playing values.

2. Description of the Prior Art

Gaming machines that simplify games played in casinos have been prevailing on the market. An example of these gaming machines allows card games such as black jack to be played. Such a gaming machine has hitherto been proposed which comprises a shared display device that displays an image of a dealer who deals cards for players and a plurality of individual display devices (corresponding to satellites or player terminals) that display information images of a card game such as images of cards dealt to players (see, for example, Japanese Patent Laid-Open No. 2004-8706; paragraphs [0039] and [0042], FIG. 1). If cards are to be dealt, the dealer image is displayed in the direction in which individual display devices for which card dealing is carried out are installed, that is, the dealer image is displayed so that players who are the operators of the individual display devices sit opposite the dealer image.

With the above game machine, since each player uses one individual display device, the maximum number of players who are allowed to play the game at the same time is limited to the number of individual display devices. With all the individual display devices operated by the players, other players willing to play the game must wait until the players now playing the game end it. The waiting players may thus feel bored until the game is over. The waiting players may also lose their enthusiasm for the game during waiting and leave the gaming machine without playing the game.

To solve this problem, it is possible to increase the number of individual display devices. However, the gaming machine providing a card game or the like limits the number of players playing the game at the same time owing to the following characteristics of the game: the finite number and type of cards used for the game, and the loss of a sense of speed caused by an increase in the amount of time required for each game resulting from the increased number of players. Consequently, the simple increase in the number of individual display devices may deaden the players' interest in the game.

An object of the present invention is to provide a multi-player gaming machine that enables players waiting for players now playing a game to end it, to enjoy the game during waiting.

SUMMARY OF THE INVENTION

The present invention offers features described below as means for solving the above problems.

A multi-player gaming machine according to the present invention has a first game section providing a first game (for example, a main game; a card game such as a black jack) which can be played upon a bet amount (for example, coins, medals, or credits) by a plurality of first game players (for example, main players) at the same time and in which awards based on the bet amount are paid out to the first game players in accordance with an outcome of the game, and a second game section (for example, a sub-game section) providing a second game in which second game players (for example, sub-players) bet on the game outcome for the first game players and in which awards based on the bet amount are paid out to the second game players in accordance with an outcome of the game. In the multi-player gaming machine, the first game section sends first game status information (for example, main game status information) indicating a status of the first game to the second game section. The second game section determines a bet acceptance period of the second game on the basis of the first game status information.

The above multi-player gaming machine enables even players or clients who are not allowed to play the first game owing to a limitation on the number of players or the like to enjoy the progress and outcome of the first game. The multi-player gaming machine also determines the bet acceptance period of the second game in association with the bet acceptance period of the first game. This allows the second game players to have a strong sense of participation in the first game. As a result, the second game players can pass the period during which they must wait before being allowed to play the first game, without feeling bored.

The multi-player gaming machine may also have the following characteristics. The first game status information contains information indicating a bet acceptance end time of the first game. The second game section determines the bet acceptance period of the second game on the basis of the information indicating the bet acceptance end time.

This multi-player gaming machine enables the bet acceptance end time or the like of the second game to be determined in association with the bet acceptance end time of the first game.

The multi-player gaming machine may also have the feature that he first game status information contains information indicating a game start time of the first game. The second game section determines the bet acceptance period of the second game on the basis of the information indicating the bet acceptance start time.

This multi-player gaming machine enables the bet acceptance start time or the like of the second game to be determined in association with the bet acceptance start time of the first game.

The multi-player gaming machine may also have the feature that odds determined on the basis of the playing values bet for the awards of the second game vary according to the first game status information.

The multi-player gaming machine varies the second game odds according to variations in the status of the first game. This makes it possible to make the second game players keenly interested in the progress of the first game. The second game players can thus pass the period during which they must wait before being allowed to play the first game, without feeling bored.

The multi-player gaming machine may have a further feature that the first game status information contains a bet acceptance end time of the second game and a period allowed before the bet acceptance is ended.

This feature of the invention enables bets from the second game players to be accepted for a predetermined time after the betting at the main game has been ended. The second game players, therefore, can confirm the first game players' bet amounts before determining their bets for the second game. The multi-player gaming machine may have a further feature that the awards for the second game players are determined on the basis of the outcomes of the first game for the first game players selected by the second game players as the bet targets.

This feature allows the second game players' awards to be determined depending on the progress of the game for the first game players. The second game players are thus attracted to the first game, with their motivations to play the game enhanced.

The multi-player gaming machine may have a further feature that the second game players' bet amounts are determined depending on the bet amount of the first game players selected by the second game players as the player's bet targets.

This feature allows the second game player's bet amount to be determined depending on the progress of the game for the main players. This enables the second game players to be attracted to the first game, with their motivations to play the game enhanced.

A multi-player gaming machine according to the present invention may comprise a display for showing a virtual dealer in play of an interactive card game; a plurality of first terminals (for example, main game sections) for a plurality of first players (for example, main players) to engage in the card game with the virtual dealer and virtual cards; at least one second terminal (for example, a sub-game section) for a second player (for example, sub-players) to bet on the first players of the card game; and a processor in communication with the display, the first terminals and the second terminal, wherein the processor is operable to: (a) execute the card game upon a bet made by the first players; (b) set a bet acceptance period of the second game based on the first game information; (c) execute the second game upon a bet made by the second player based on the bet acceptance period; (d) determine the outcome of the card game; and (e) award to the first players and the second player in accordance with the card game outcome and bet amount of each player.

The present invention provides a method for executing a multi-player game including a first game (for example, a main game) which can be played upon a bet by a plurality of first game players (for example, main players) at the same time, and a second game (for example, a sub-game) in which a plurality of second game players (for example, sub-players) bet on the game outcome of the first game players. The method according to the present invention may comprise the steps of: providing first game status information indicating a status of the first game; determining a bet acceptance period of the second game on the basis of the first game status information; paying out awards based on the bet amount to the first game players in accordance with the game outcome of the first game; and paying out awards based on the bet amount to the second game players in accordance with the game outcome of the first game.

The accompanying drawings, which are incorporated in and constitute a part of the specification, illustrate embodiments of the invention, and together with the general description given above and the detailed description of the embodiments given below, serve to explain the principles of the invention.

DESCRIPTION OF THE PREFERRED EMBODIMENTS

Embodiments according to the present invention will be described below with reference to the drawings.

[1. Appearance of the Multi-player gaming machine]

Figure 1:
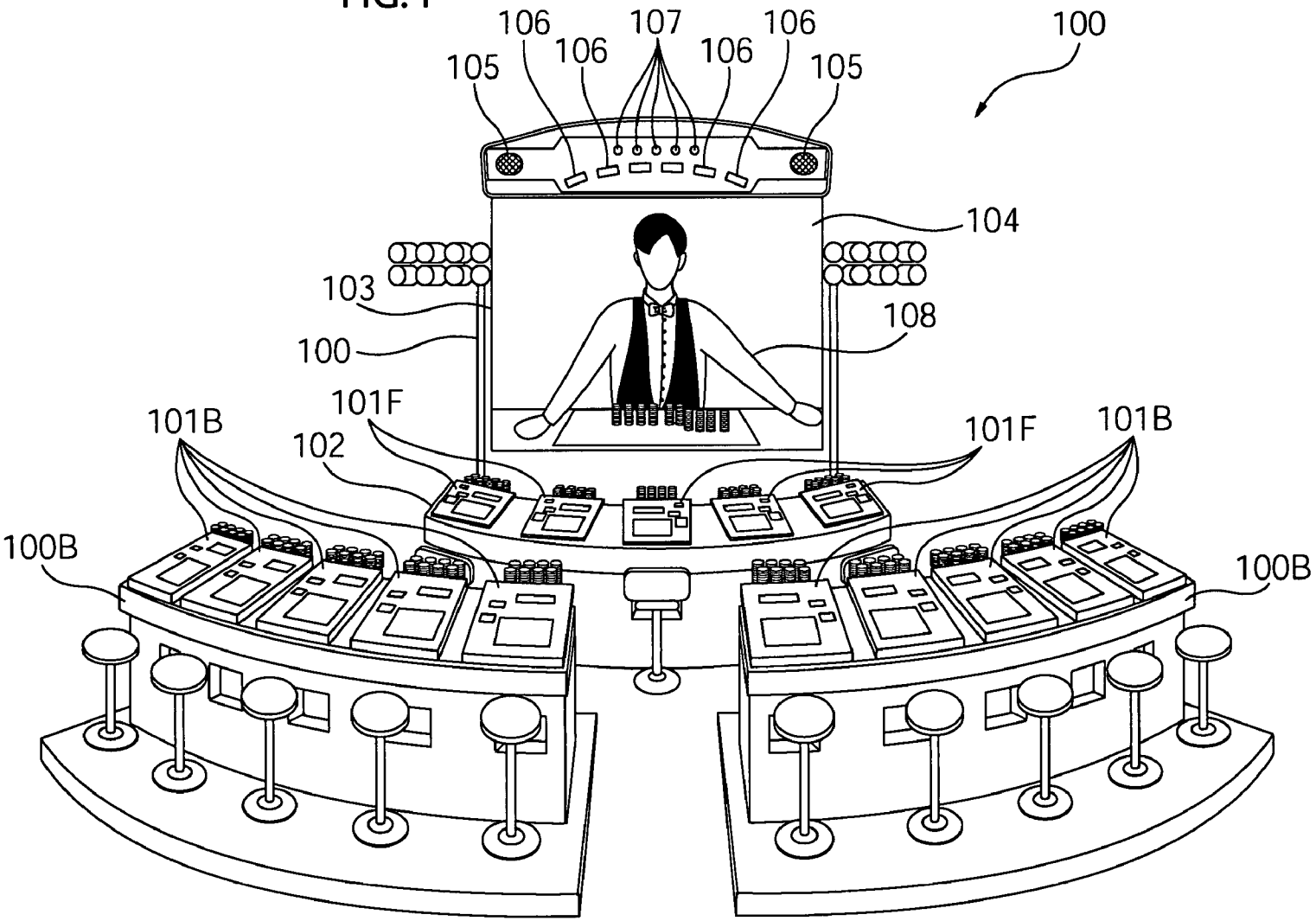
FIG. 1 is a perspective view showing the appearance of a multi-player gaming machine.

FIG. 1 is a diagram showing the appearance of a game machine according to the present embodiment. In the description below, a game machine 100 according to the present embodiment includes a program for black jack, which is a card game carried out by the multi-player gaming machine (hereinafter "gaming machine") 100. However, this does not limit the gaming machine according to the present invention to one that executes black jack.

As shown in FIG. 1, the gaming machine 100 has a main game section 100A and two sub-game section 100B communicatively connected to the main game section 100A.

The main game section 100A has a terminal section 102 in which main player terminals 101F called satellites are arranged generally like a fan, and a panel section 103 placed behind the terminal section 102 as viewed by operators (players) in the terminal section 102. The sub-game section 100B has five built-in sub-player terminals 101B. Players who are the operators of main player terminals 101F are called main players. Players who are the operators of the sub-player terminals 101B are called sub-players. In the present embodiment, the main players play main games (including all games played in what is called casinos or the like, for example, card games such as black jack, baccarat and poker, and table games such as roulette) provided by the main game section 100A. The sub-players play a sub-game in which they bet playing values on the outcome of the main game played by main players.

The panel section 103 has a front display 104 that is a display device such as a liquid crystal display device, a speaker 105, a lamp 106, and an LED 107. The front display 104 transmits information on games in which the main players and/or sub-players participated, to each of the players.

The front display 104 uses an animated dealer 108 and other images to notice the players of the start of a bet time, the end of the bet, and the outcome of the game.

The speaker 105, lamp 106, and LED 107 stage games, for example, output of BGM, sound effects or the like, or illumination/extinction, in synchronism with or independently of the image display on the front display 104.

Figure 2:
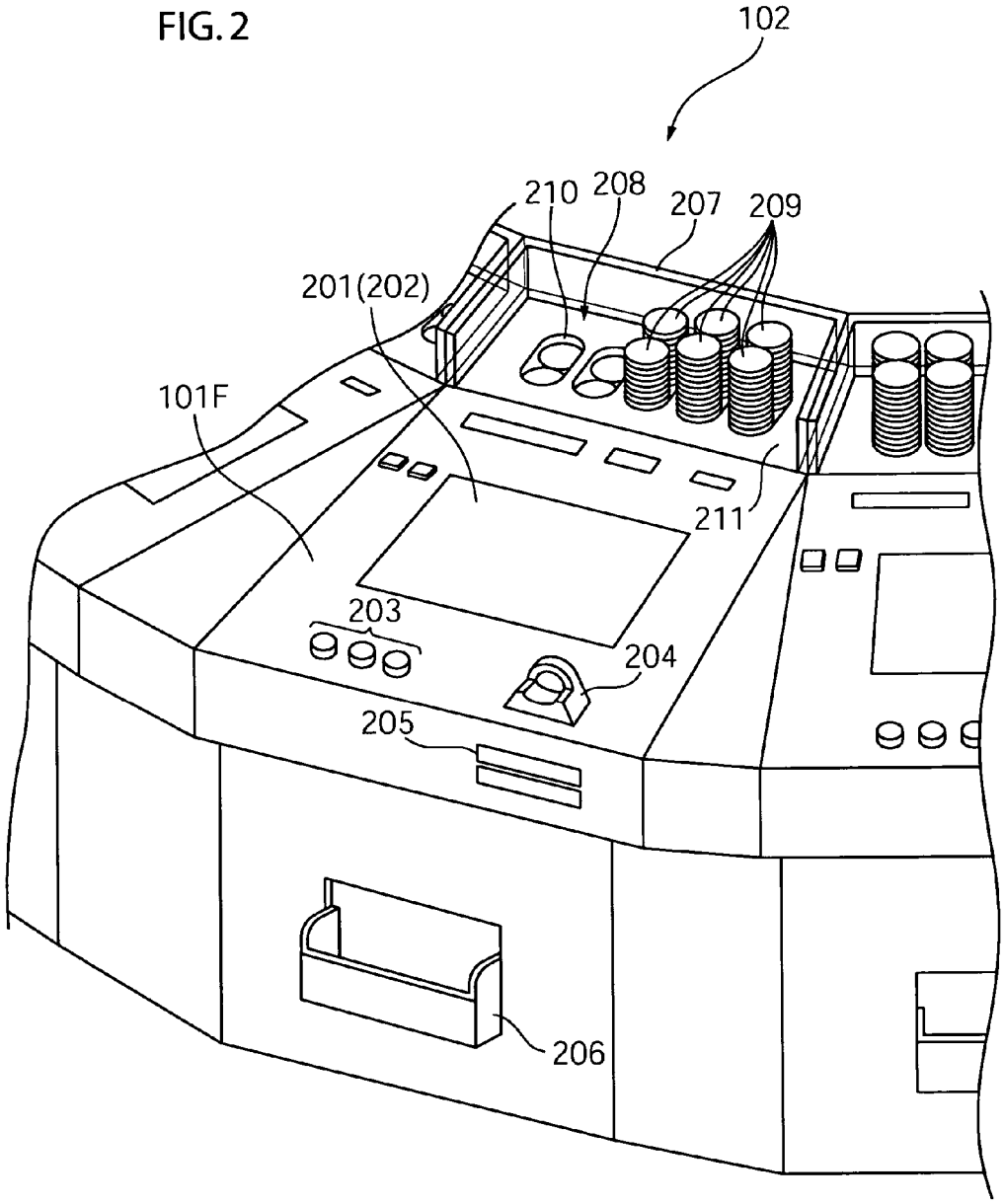
FIG. 2 is a perspective view of a player terminal.

FIG. 2 shows a partly enlarged view of the terminal section 102. With reference to FIG. 2, description will be given of the terminal section 102 and the main player terminal 101F, incorporated in the terminal section 102.

The main player terminal 101F has a liquid crystal display 201 on its top surface to provide players with information on games. The liquid crystal display 201 is covered with a transparent touch panel 202 and displays an input interface screen. In addition to an input interface screen displayed by the liquid crystal display 201, a button group 203 is arranged at this side of the liquid crystal display 201 and includes a plurality of buttons such as a PAYOUT button and a BET button which are used for games by the player. A coin inserting section 204 is provided to the right of the button group 203 so that the player can insert playing value media such as coins, medals, or chips (hereinafter, simply referred to as coins) through the coin inserting section 204. A bill inserting section 205 is provided below the coin insertion section 204 so that the player can insert bills through the bill inserting section 205. A coin sensor (not shown) is placed in the coin inserting section 204. Inserting a coin through the coin inserting section 204 outputs a coin detection signal via the coin sensor. A bill sensor (not shown) is also placed in the bill inserting section 205. Inserting a bill through the bill inserting section 205 outputs a bill detection signal via the bill sensor.

A coin payout port 206 is provided at the bottom of front surface of the main player terminal 101F. When the player depresses the payout button, one of the buttons in the button group 203, coins are ejected from the coin payout port 206, the number of coins corresponding to all or a part of the player's owned credit value stored in the main player terminal 101F. The player can thus acquire the coins.

A U-shaped transparent acrylic panel 207 is provided in front of the liquid crystal display (the transparent acrylic panel 207 is closer to the panel section 103 than the liquid crystal display 201). A three-dimensional model chip presenting section 208 is provided in an area enclosed by the transparent acrylic panel 207. The three-dimensional model chip presenting section 208 is composed of three-dimensional model chips 209, a presenting section plate 211 in which openings 210 are formed so that the three-dimensional model chips 209 can project from inside to outside of the player terminal 101 through the openings 210 or so that the projecting three-dimensional model chips 209 can be housed inside the terminal 101 through the openings 210, and an elevating and lowering mechanism (described below) that elevates and lowers the three-dimensional model chips 209.

The three-dimensional model chips 209 are a pile of model chips into which resin or the like is molded. Each three-dimensional model chip presenting section 208 may have a plurality of model chips 209 in different units. For example, the three-dimensional chips may model a pile of chips at one credit per chip, a pile of chips at 10 credits per chip, and a pile of chips at 100 credits per chip.

The three-dimensional model chips 209 are elevated or lowered by the elevating and lowering mechanism depending on the number of chips credited in the gaming machine 100, that is, an owned credit value by the main player who operates the main player terminal 101F in which that three-dimensional model chip presenting section 208 is provided. For example, if the player's owned credit value is "251", the three-dimensional model chips are elevated or lowered so that the three-dimensional model chips modeling the pile of chips for one credits project from the presenting section plate 211 by a height corresponding to the thickness of one chip, so that the three-dimensional model chips modeling the pile of chips for 10 credits project from the presenting section plate 211 by a height corresponding to the thickness of five chips, and so that the three-dimensional model chips modeling the pile of chips for 100 credits project from the presenting section plate 211 by a height corresponding to the thickness of two chips.

All the players view the heights by which the three-dimensional model chips 209 project from the presenting section plate 211. The players can thus quickly and intuitively determine their owned credit values. The players also get a sense of reality; the players feel as if the number of chips was actually increased or reduced before them.

The sub-game section 100B will be described. The sub-player terminal 101B, incorporated into the sub-game section 100B, is the same as the main player terminal 101F, described above. Thus, the detailed description of the sub-player terminal 101B will be omitted.

Figure 3:
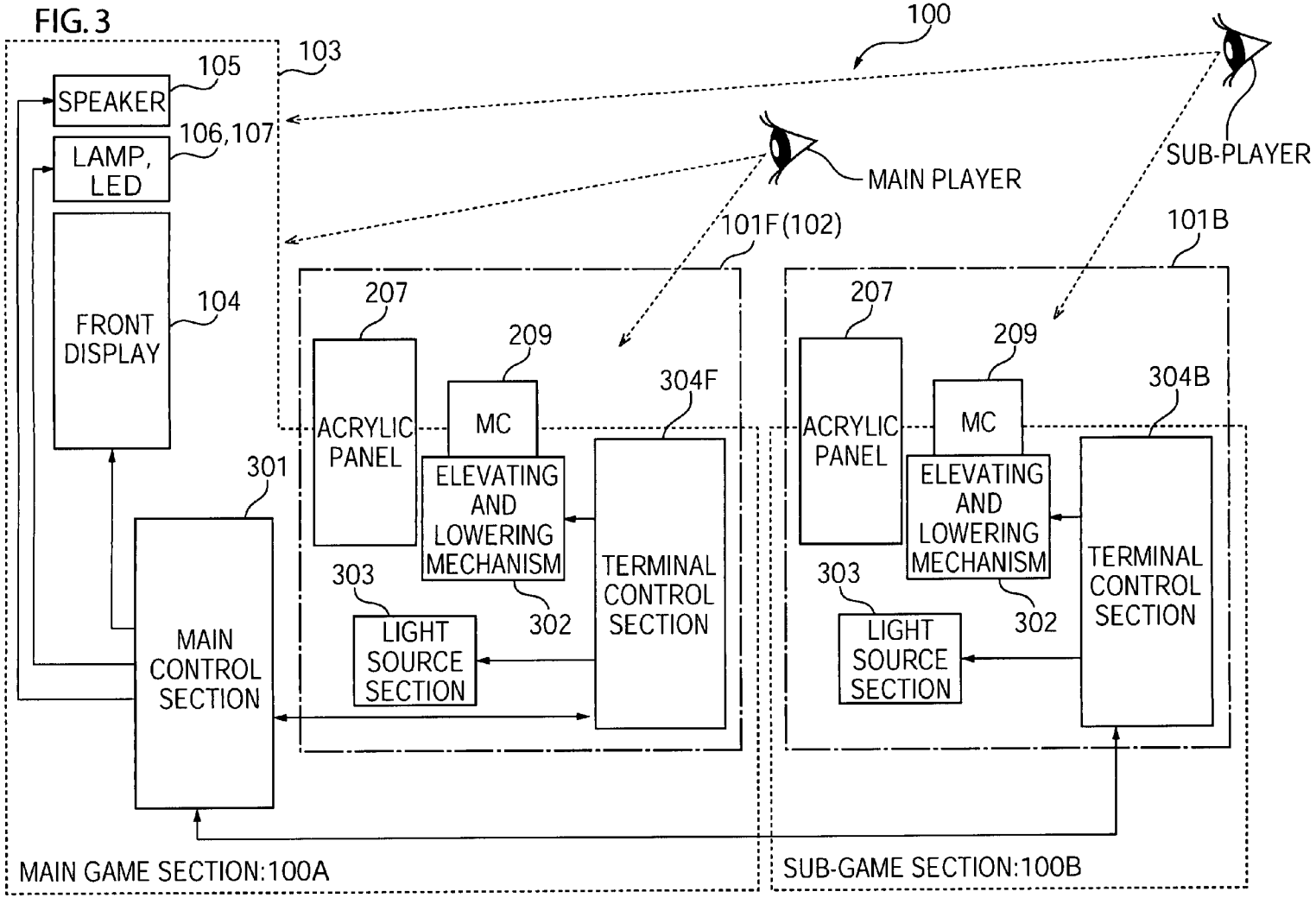
FIG. 3 is a block diagram showing a control system of the game machine.

FIG. 3 is a schematic block diagram showing the exemplary internal structure of the gaming machine 100. The main game section 100A stores a main control section 301 composed of an information processing device that executes game programs, and peripheral devices. The main control section 301 is connected to each of the main player terminals 101F and sub-player terminals 101B for bidirectional communications. The main control section 301 receives the number of bet chips, a bet target, and the like from each of the main player terminals 101F and sub-player terminals 101B. With predetermined conditions met, the main control section 301 starts executing a game. The main control section 301 then determines the winners and losers of the main game and sub-game and notices the game outcome to each player terminal 101.

Each main player terminal 101F increases or reduces the main player's owned credit value in accordance with the notice from the main control section 301. For example, if any main player wins the game, the corresponding main player terminal 101F adds a credit value corresponding to the number of chips acquired, to the owned credit value and re-stores the sum in accordance with the notice from the main control section 301. If any main player loses the game, the corresponding main player terminal 101F subtracts a credit value corresponding to the number of bet chips, from the owned credit value and re-stores the difference in accordance with the notice from the main control section 301.

Each sub-player terminal 101B operates similarly to the main player terminal 101F for sub-games. Each sub-player terminal 101B increases or reduces the sub-player's owned credit value in accordance with the notice from the main control section 301. For example, if any sub-player wins the game, the corresponding sub-player terminal 101B adds a credit value corresponding to the number of chips acquired, to the owned credit value and re-stores the sum in accordance with the notice from the main control section 301. If any sub-player loses the game, the corresponding sub-player terminal 101B subtracts a credit value corresponding to the number of bet chips, from the owned credit value and re-stores the difference in accordance with the notice from the main control section 301.

The main control section 301 also drivingly controls the output of image signals displayed on the front display 104, as well as the lamp 106, LED 107, and speaker 105.

The main player terminal 101F has a terminal control section 304F composed of an information processing device and peripheral devices, an elevating and lowering mechanism 302 connected to the terminal control section 304F, and a light source section 303.

The elevating and lowering mechanism 302 is means for elevating and lowering the three-dimensional model chips 209. The present embodiment uses a stepping motor as elevating or lowering power but an ordinary motor may be used in combination with a position control mechanism.

The specific configuration of the elevating and lowering mechanism 302 will be described with reference to FIG. 4.

Figure 4:
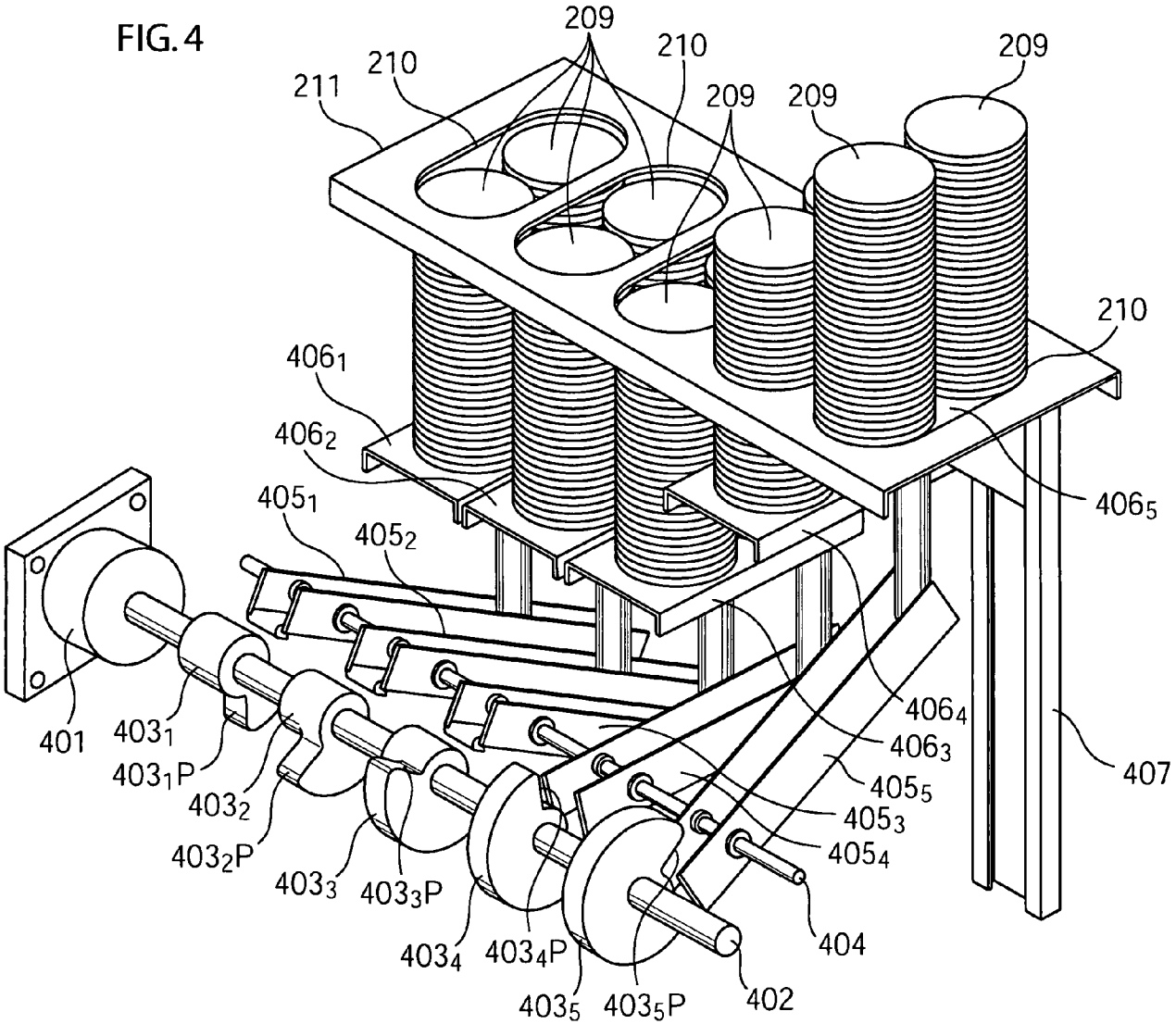
FIG. 4 is a perspective view showing an example of an elevating and lowering mechanism.

The elevating and lowering mechanism 302, shown in FIG. 4, has a rotational driving shaft 402 attached to a stepping motor 401, abutting members $\mathbf{403}_1$ to $\mathbf{405}_5$ fixed to the rotational driving shaft 402 and rotating in unison with the rotational driving shaft 402, arm sections $\mathbf{405}_1$ to $\mathbf{405}_5$ pivotably attached via a support shaft 404 at positions where first ends of the arm positions abut against abutting surfaces $\mathbf{403}_1$P to $\mathbf{403}_5$P of the respective abutting members $\mathbf{403}_1$ to $\mathbf{403}_5$, and table sections $\mathbf{406}_1$ to $\mathbf{406}_5$ attached to second ends of the respective arm sections $\mathbf{405}_1$ to $\mathbf{405}_5$. The three-dimensional model chips 209 are fixedly placed on a top surface of each of the table sections $\mathbf{406}_1$ to $\mathbf{406}_5$. Each of the table sections $\mathbf{406}_1$to $\mathbf{406}_5$ is guided along a sliding rail 407 so that the three-dimensional model chips 209 are regulated to pass correctly through the corresponding opening 210.

In the example shown in FIG. 4, five types of three-dimensional model chips 209 are elevated and lowered. Thus, the five abutting members $\mathbf{403}_1$ to $\mathbf{403}_5$, five abutting surfaces $\mathbf{403}_1$P to $\mathbf{403}_5$P, five arm sections $\mathbf{405}_1$ to $\mathbf{405}_5$, and five table sections $\mathbf{406}_1$ to $\mathbf{406}_5$ are provided. These components are shown with subindices for distinction within each component type. However, if they need not be distinguished from one another within the component type, they are simply denoted as the abutting member 403, abutting surface 403P, arm section 405, and table section 406.

Now, description will be given of the operation of the elevating and lowering mechanism 302, shown in FIG. 4.

When the stepping motor 401 driven by the player terminal 101 rotates the rotational driving shaft 402, the abutting member 403 is rotated. Further rotation of the abutting member 403 abuts the abutting surface 403 against the first end of the arm section 405. In this embodiment, the abutting surface $\mathbf{403}_5$P abuts the first end of the arm section $\mathbf{405}_5$ earliest. Subsequently, the abutting surfaces $\mathbf{403}_4$P, $\mathbf{403}_3$P, $\mathbf{403}_2$P, and $\mathbf{403}_1$P sequentially abut against the first ends of the respective arm sections $\mathbf{405}_4$ to $\mathbf{405}_1$ in this order.

After the abutting surface 403P abuts the first end of the arm section 405, further rotation of the abutting member 403 causes the abutting surface 403P to push down the first end of the arm section 405.

The arm section 405 having its first end pushed down pivots around a support shaft 404, with its second end pushed up. This also pushes up the table section 406 fixed to the second end of the arm section 405. The three-dimensional model chips 209 placed on the table section 406 are also raised. As a result, depending on the amount of rotation of the rotational driving shaft 402 by the stepping motor 401, some or all of the three-dimensional model chips 209 can be passed through the opening 210 and projected and exposed from the presenting section plate 211.

Further, reverse rotation of the stepping motor 401 enables the presenting section plate 211 to be projected so that some or all of the exposed three-dimensional model chips 209 can be accommodated below the presenting section plate 211.

In the exemplary configuration shown in FIG. 4, the abutting members $\mathbf{403}_1$ to $\mathbf{403}_5$ are shaped so that the abutting surfaces $\mathbf{403}_1$P to $\mathbf{403}_5$P abut against the first ends of the arm sections $\mathbf{405}_1$ to $\mathbf{405}_5$ at different abutting timing. Accordingly, the rightmost pile of three-dimensional model chips 209 in the figure starts to rise earliest. The remaining piles of three-dimensional model chips 209 sequentially start to rise from right to left of the figure. The present embodiment utilizes this nature and distinguishingly colors or patterns the three-dimensional model chips so that the rightmost pile of three-dimensional model chips 209 has the lowest value per chip (for example, one credit per chip) and so that the value per chip increases toward the leftmost pile (for example, 5, 10, 100, and 1,000 credits per chip). This enables a wide range of owned credit values such as 1 to 100,000 credits to be expressed by the amount by which the three-dimensional model chips 209 project from the presenting section table 211.

Figure 5:
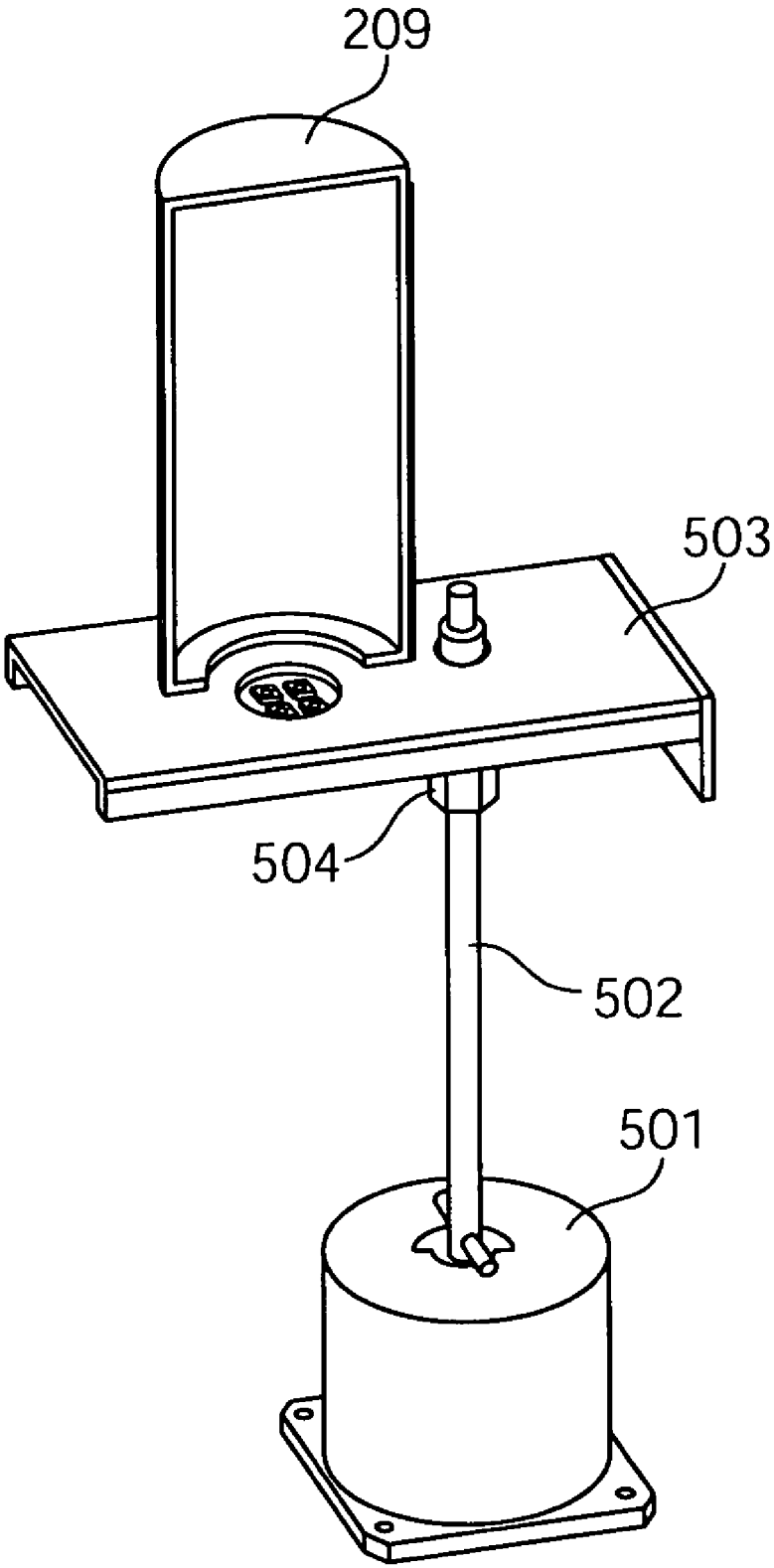
FIG. 5 is a perspective view showing another example of the elevating and lowering mechanism.
Figure 6:
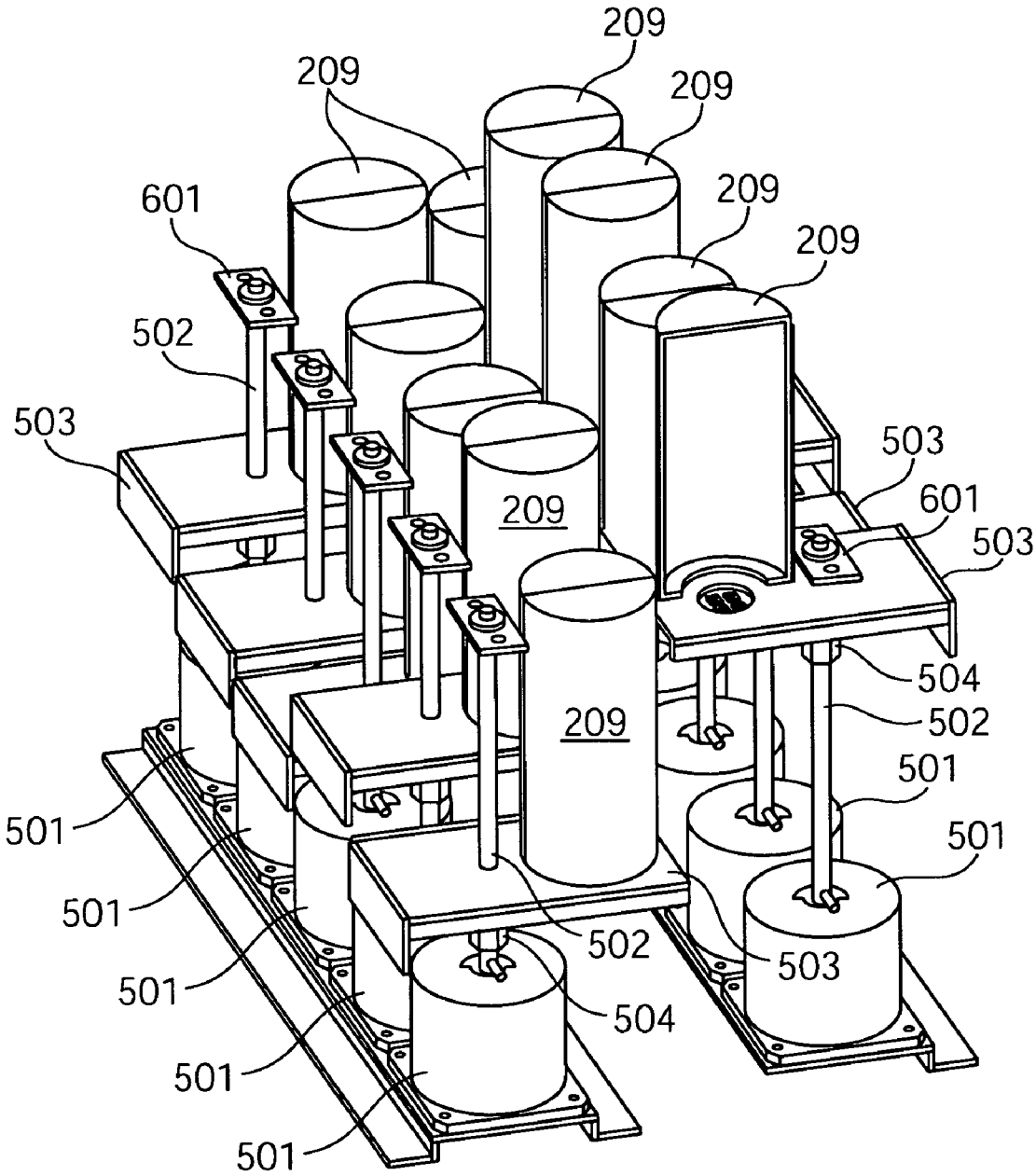
FIG. 6 is a perspective view showing another example of the elevating and lowering mechanism.

Now, FIGS. 5 and 6 show another exemplary configuration of the elevating and lowering mechanism 302. FIG. 5 is a perspective view of a basic unit of this exemplary configuration of the elevating and lowering mechanism 302. A plurality of the basic units constitute one elevating and lowering mechanism 302.

The basic unit of the elevating and lowering mechanism 302 has a rotational driving shaft 502 which is rotationally driven by a stepping motor 501 and to which the table section 503 is attached.

The three-dimensional model chips 209 are placed on the top surface of the table section 503 as is the case with the above example. Each three-dimensional model chip 209 is formed of laterally laminated hollow semi-cylinders. FIG. 5 shows one of the hollow semi-cylinders before lamination. Although not shown in the drawings, the three-dimensional model chip 209 is elevated and lowered so as to project and retract through the opening 210 in the presenting section plate 211 as is the case with the above example.

A nut 504 is secured to the bottom of the table section 503. A screw thread and a thread groove (not shown) are formed on an outer peripheral surface of the rotational driving shaft 502. The nut 504 and the rotational driving shaft 502 are threadably fitted together.

The table section 503 is regulated so as not to rotate in unison with the rotational driving shaft 502. For example, a guide rail may be provided to regulate the rotation of the table section 503 as is the case with the above example (vertical movement is not regulated). Alternatively, the rotation of the table section 503 may be regulated by slidably abutting the table section 503 against an inner wall of the gaming machine 100 (vertical movement is not regulated).

Rotating the rotational driving shaft 502 threadably moves the table section 503 forward or backward. In other words, controlling rotational driving of the stepping motor 501 makes it possible to control the elevation and lowering of the table section 503, that is, the three-dimensional model chips 209 placed on the table section 503.

FIG. 6 is a perspective view showing an example in which the elevating and lowering mechanism 302 is composed of a plurality of the basic units. In this example, the elevating and lowering mechanism 302 is composed of five basic units arranged in line and on which the respective three-dimensional model chip piles 209 are placed, and other five basic units arranged in line and on which the respective three-dimensional model chips 209 are placed. Each of the basic units has the stepping motor 501 and can thus independently control the elevation and lowering of the three-dimensional model chips 209.

Thus, the elevating and lowering mechanism 302 configured as described above makes it possible not only to use the elevation and lowering of the three-dimensional model chips 209 to display the owned credit value but also to provide other displays. For example, if the player of any player terminal gets a big win, the operation of the three-dimensional model chips 209 can be staged so that the chips 209 sequentially elevate or lower from right to left or left to right like waves.

Referring back to FIG. 3, the general configuration of the gaming machine 100 will further be described.

The terminal control section 304 of the main player terminal 101F is connected to the light source section 303 to control the light emitting operation of the light source section 303. The light emitting section 303 is a circuit having a light emitting source such as a plurality of LEDs and functions as a light source that can provide different colors (for example, red, blue, green, and white) and that allows luminance to be varied. Light emitted by the light emitting source 303 is guided through the acrylic panel 207 to the outside of the gaming machine 100, particularly in the direction in which the light is viewed by the player.

Now, the sub-player terminal 101B will be described.

The sub-player terminal 101B has a terminal control section 304B composed of an information processing device and peripheral devices, the elevating and lowering mechanism 302, connected to the terminal control section 304, and the light source section 303. The elevating and lowering mechanism 302 operates the three-dimensional model chips 209, and the light source section 303 controls the light emission from the acrylic panel 207. The elevating and lowering mechanism 302, light source section 303, acrylic panel 207, three-dimensional model chips 209 are similar to those of the main player terminal 101F, with their detailed description omitted.

[2. Exemplary Configuration of the Main Control Section]

Figure 7:
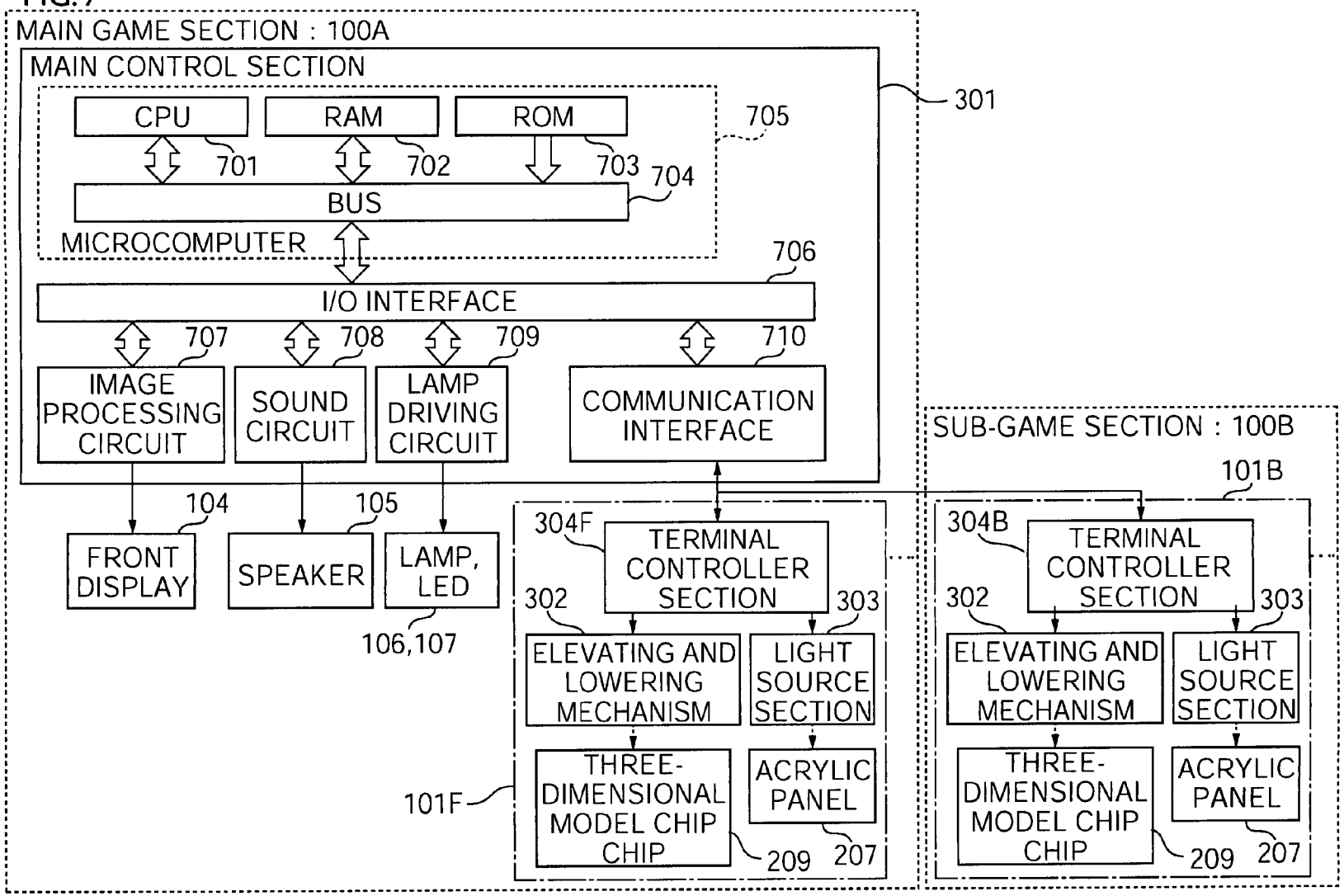
FIG. 7 is a functional block diagram showing the exemplary configuration of a main control section.

The exemplary configuration of the main control section 301 will be described with reference to FIG. 7, which is a block diagram of the gaming machine 100, focusing on the main control section 101.

The main control section 301 is basically composed of a microcomputer that serves as the core of the main control section 301 and that is composed of a CPU 701, a RAM 702, a ROM 703, and a bus 704 that transfer data among the CPU 701 and RAM 702 and ROM 703. The CPU 701 connects to the ROM 703 and RAM 702 via the bus 704. The ROM 703 stores programs, data tables, and the like which are required for the gaming machine 100 to execute processing required for control. The RAM 702 is a memory that temporarily stores data calculated by the CPU 701.

The microcomputer 705, more specifically, the CPU 701, is connected to an image processing circuit 707 via an I/O interface 706. The image processing circuit 707 is connected to the front display 104 to control its driving.

The image processing circuit 707 is composed of a program ROM, an image ROM, an image control CPU, a work RAM, a VDP (Video Display Processor), and a video RAM. The program ROM stores an image control program and selection tables for the display on the front display 104. The image ROM stores dot data required to form images on, for example, the front display 104. The image control CPU determines images to be displayed on the front display 104, on the basis of parameters set by the CPU 701 in accordance with the image control program, pre-stored in the program RAM; the images are formed of selected ones of the dot data pre-stored in the image ROM. The work RAM is configured as temporary storage means used when the image control CPU executes the image control program. The VDP generates image data corresponding to the display contents determined by the image control CPU to output the image data to the front display 104. The video RAM is configured as temporary storage means used when the VDP forms images.

The microcomputer 705, more specifically, the CPU 701, connects to the speaker 105 via a sound circuit 708. The speaker 105 generates various sound effects, BGM, and the like for various types of staging on the basis of output signals from the sound circuit 708.

The microcomputer 705, more specifically, the CPU 701, connects to the lamp 106 and LED 107 via a lamp driving circuit 709. A large number of lamps 106 and LEDs 107 are disposed on a front surface of the gaming machine 100 and controllably illuminated for various types of staging by a lamp driving circuit on the basis of drive signals from the CPU 701.

The microcomputer 705, more specifically, the CPU 701, connects to the main player terminals 101F and sub-player terminals 101B via a communication interface 710 for bidirectional communications between the CPU 701 and each main player terminal 101F and between the CPU 701 and each sub-player terminal 101B. The microcomputer 705, more specifically, the CPU 701, transmits and receives commands, requests, and the like to and from each main player terminal 101F via the communication interface 710. The main control section 301 and the main player terminals 101F cooperate in controlling the progress of main games. Similarly, the microcomputer 705, more specifically, the CPU 701, transmits and receives commands, requests, and the like to and from each sub-player terminal 101B via the communication interface 710. The main control section 301 and the sub-player terminals 101B cooperate in controlling the progress of sub-games.

[3. Exemplary Configuration of the Main Player Terminal]

Figure 8:
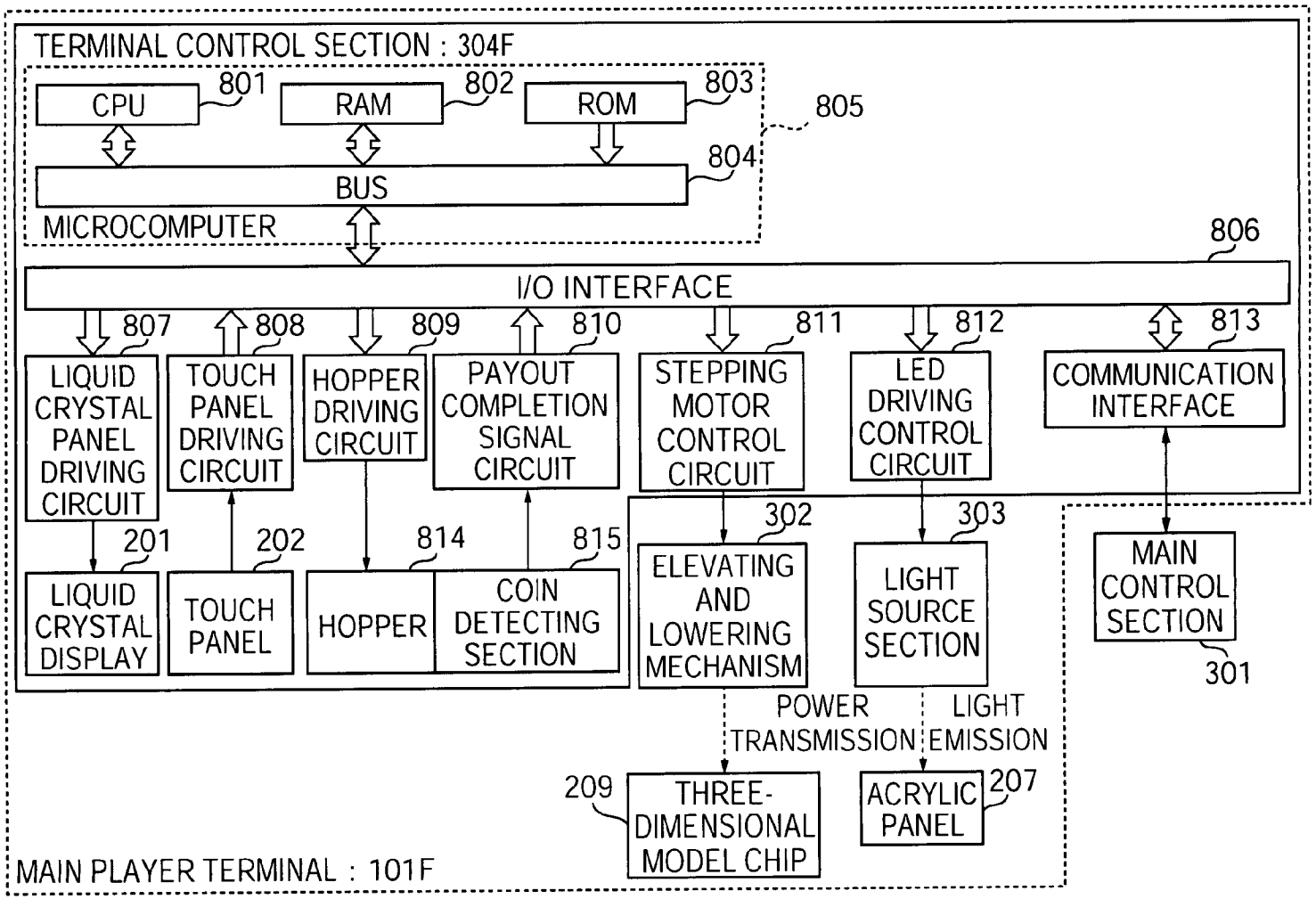
FIG. 8 is a functional block diagram showing the exemplary configuration of a main player terminal.

The exemplary configuration of the main player terminal 101F will be described with reference to FIG. 8, which is a functional block diagram showing an example of a control system of the main player terminal 101F.

The core of the main player terminal 101F is the terminal control section 304F. The terminal control section 304F is basically composed of a microcomputer 805 that serves as the core of the terminal control section 304F and that is composed of a CPU 801, a RAM 802, a ROM 803, and a bus 804 that transfer data among the CPU 801 and RAM 802 and ROM 803. The CPU 801 connects to the ROM 803 and RAM 802 via the bus 804. The ROM 803 stores programs, data tables, and the like which are required for the main player terminal 101F to execute processing required to control the main player terminal 101F, for example, the operation control for the elevating and lowering mechanism 302, illumination/extinction control for the light source section, or the like. The RAM 802 is a memory that temporarily stores data calculated by the CPU 801.

The microcomputer 805, more specifically, the CPU 801, is connected to a liquid crystal driving circuit 807 via an I/O interface 806. The image processing circuit 807 is connected to the liquid crystal display 201 to control its driving.

The microcomputer 805, more specifically, the CPU 801, is connected to a touch panel driving circuit 808 via the I/O interface 806. The touch panel driving circuit 808 outputs coordinate data on a touch position on the touch panel 202.

The microcomputer 805, more specifically, the CPU 801, connects to a hopper 814 via a hopper driving circuit 809. When the CPU 801 outputs a drive signal to the hopper driving circuit 809, the hopper 814 pays out a predetermined number of coins through the coin payout port 206. A coin detecting section 815 is also connected to the CPU 801 via a payout completion signal circuit 810. The coin detecting section 815 is located inside the coin payout port 206. Upon detecting that a predetermined number of coins have been paid out through the coin payout port 206, the coin detecting section 815 outputs a coin payout detection signal to the payout completion signal circuit 810. On the basis of the coin payout detection signal, the payout completion signal circuit 810 outputs a payout completion signal to the CPU 801.

The microcomputer 805, more specifically, the CPU 801, is connected to a stepping motor control circuit 811 that rotationally drives the stepping motor 401 (or 501), which drives the elevating and lowering mechanism 302. When the CPU 801 outputs a motor driving signal to the stepping motor control circuit 811, the stepping motor 401 (or 501) is rotationally driven by the stepping motor control circuit 811. This operates the elevating and lowering mechanism 302 to elevate or lower the three-dimensional model chips 209.

The microcomputer 805, more specifically, the CPU 801, is connected to an LED driving control circuit 812 that drives the light source section 303. In the present embodiment, the light source section 303 is composed of a plurality of LEDs. In response to an LED driving command from the CPU 801, the LED driving control circuit 812 supplies drive power to those of all the LEDs which are to be driven. This enables the LEDs to be illuminated or extinguished in a desired manner under the control of the CPU 801.

In the present embodiment, the light source section 303 is composed of five red LEDs, five blue LEDs, and five white LEDs. The LED driving control circuit 812 selectively supplies power so as to independently illuminate or extinguish the five red LEDs, five blue LEDs, and five white LEDs.

The microcomputer 805, more specifically, the CPU 801, connects to the main control section 301 via a communication interface 813 for bidirectional communications between the CPU 801 and the main control section 301. The CPU 801 transmits and receives commands, requests, data, and the like to and from the main control section 301. The main control section 301 and the main player terminals 101F cooperate in controlling the progress of main games.

[4. Exemplary Configuration of the Sub-player Terminal]

Figure 9:
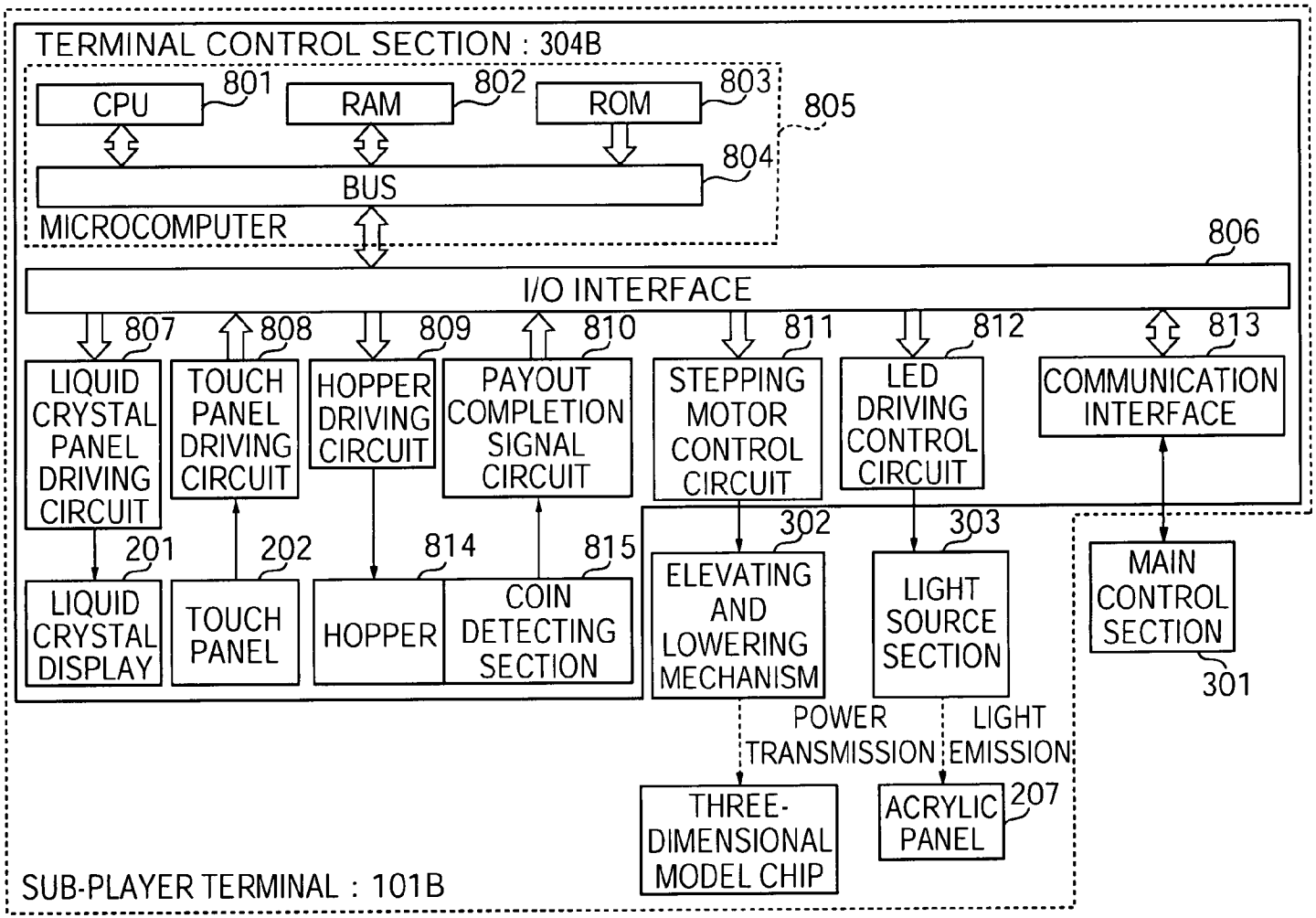
FIG. 9 is a functional block diagram showing the exemplary configuration of a sub-player terminal.

FIG. 9 is a functional block diagram showing an example of a control system of the sub-player terminal 101B. As shown in the figure, the control system of the sub-player terminal 101B is configured similarly to that of the main player terminal section 101F. The same components as those in FIG. 8 are denoted by the same reference numerals and their detailed description is omitted.

[5. Exemplary Operation of the Gaming Machine]

Figure 10:
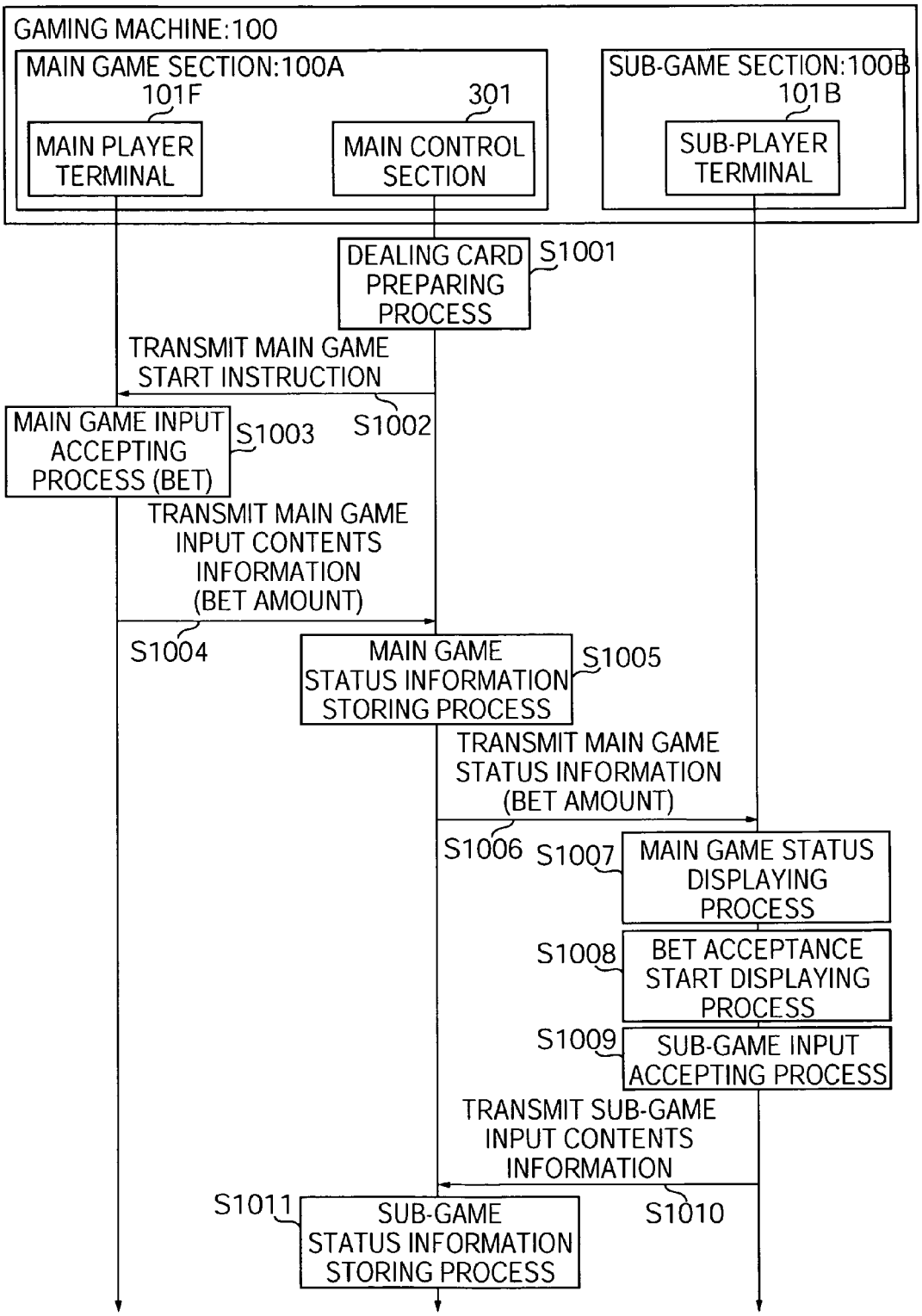
FIG. 10 is a sequence diagram showing the exemplary operation of the multi-player gaming machine.
Figure 21:
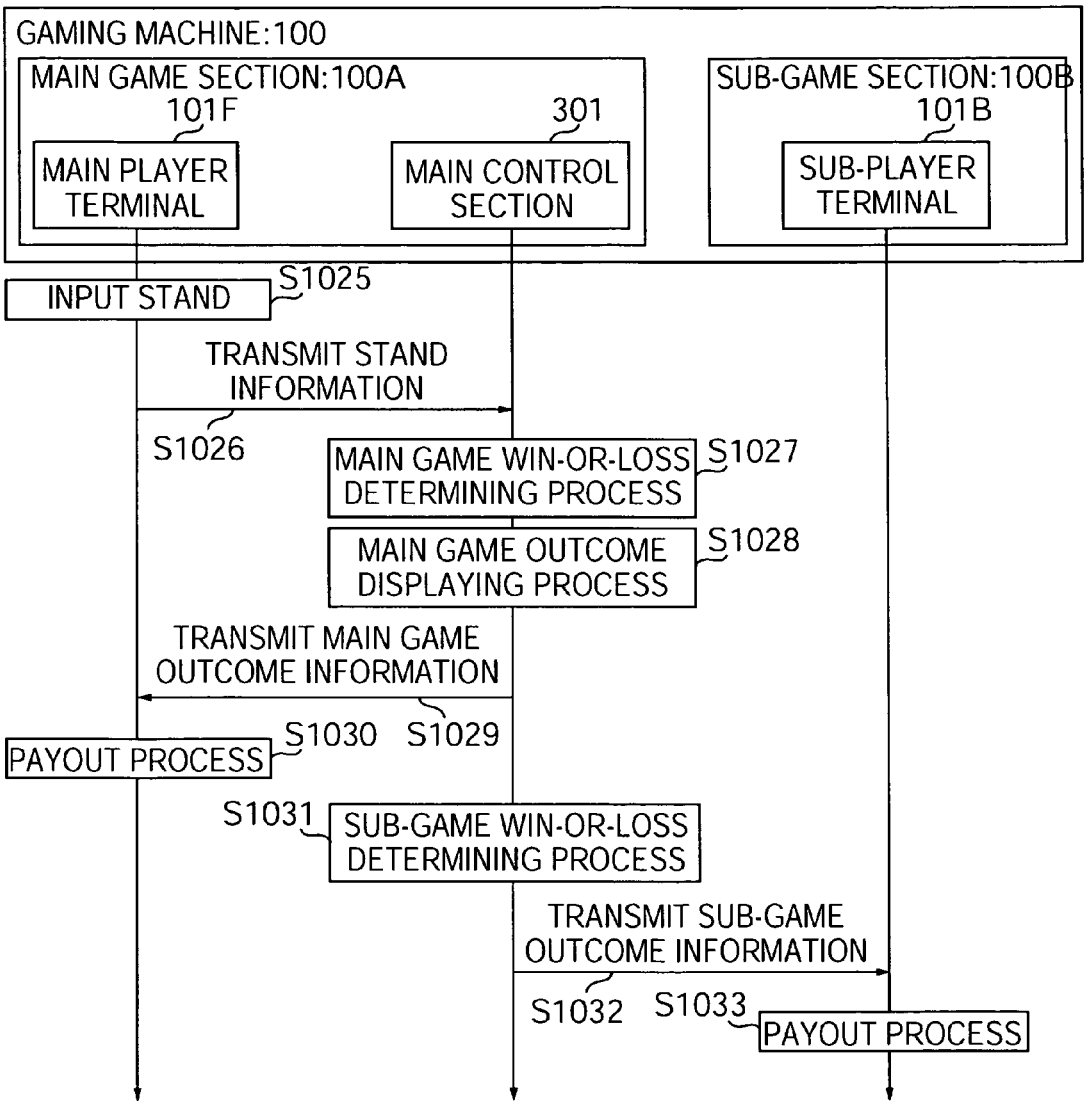
FIG. 21 is a sequence diagram showing the exemplary operation of the multi-player gaming machine and continued from the sequence diagram in FIG. 15.
Figure 22:
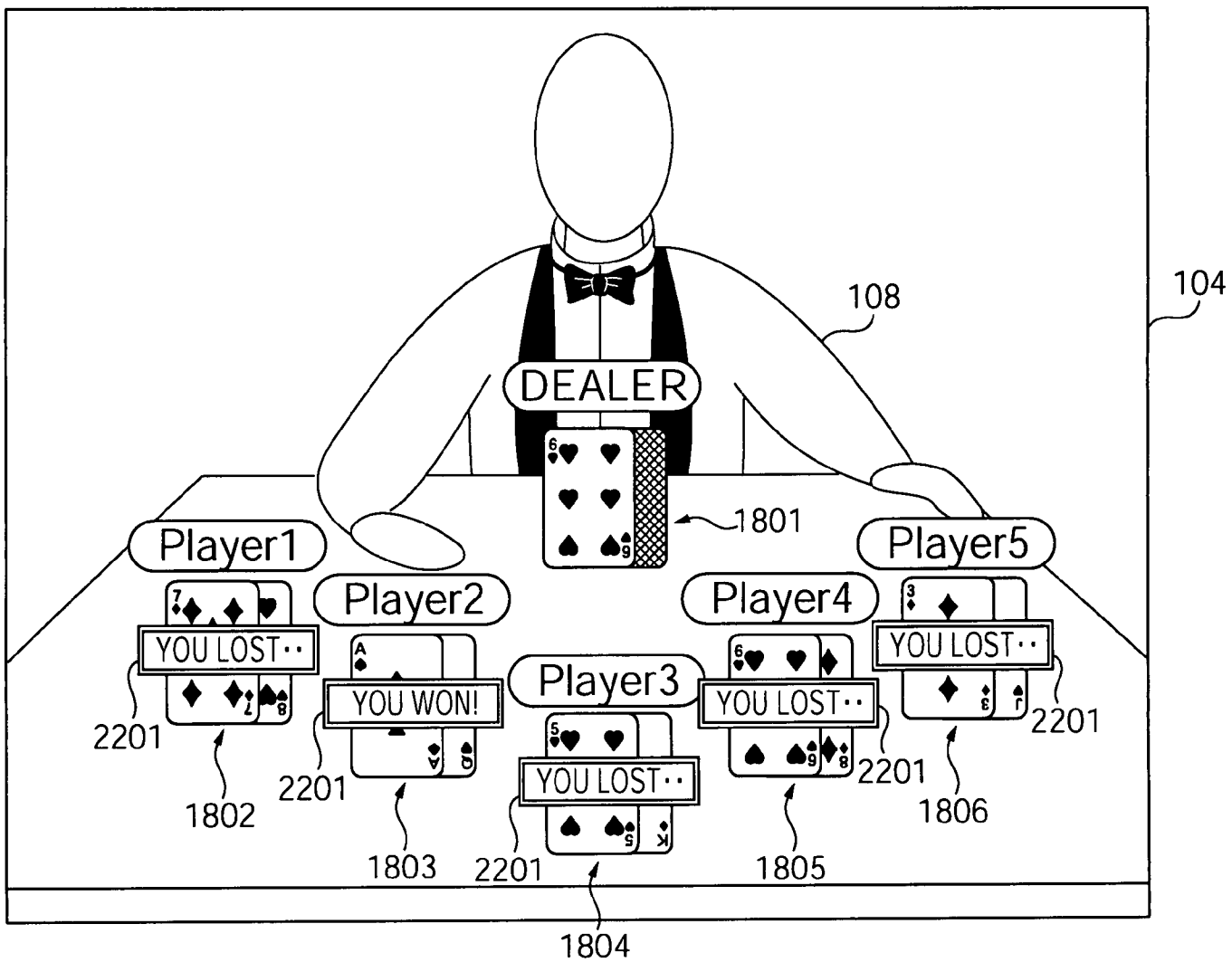
FIG. 22 is a diagram showing an exemplary screen displayed on the front display.
Figure 23:
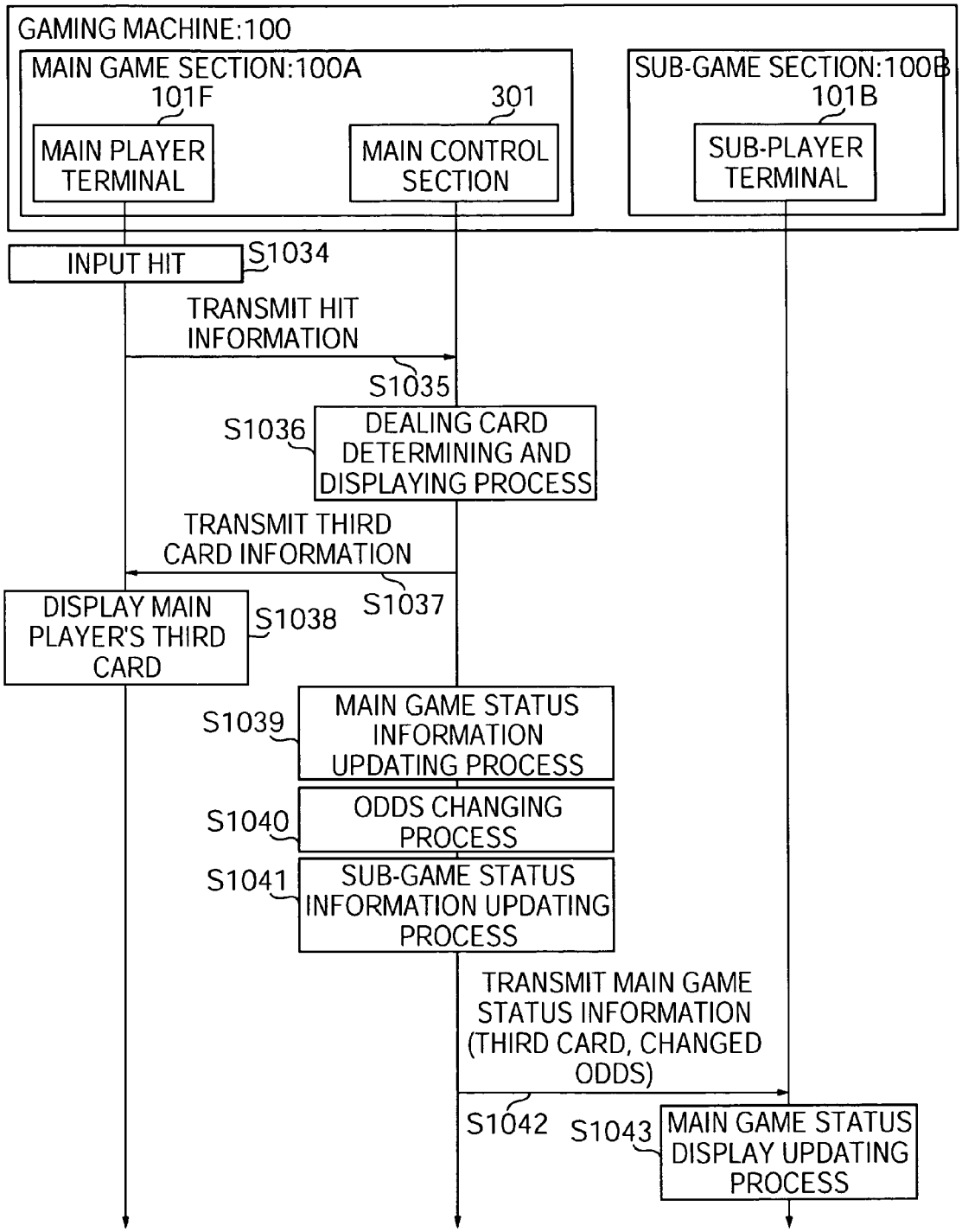
FIG. 23 is a sequence diagram showing the exemplary operation of the multi-player gaming machine and continued from the sequence diagram in FIG. 15.

With reference to FIGS. 10 to 26, description will be given of the exemplary operation of the gaming machine 100 according to the present embodiment. FIG. 10 is a sequence diagram showing the exemplary operation of the gaming machine 100. FIG. 15 is a sequence diagram continued from FIG. 11. FIG. 21 is a sequence diagram continued from FIG. 15. FIG. 23 is a sequence diagram continued from FIG. 15 and in which a selection different from that in FIG. 21 is made. With reference to these sequence diagrams, the exemplary operation of the gaming machine 100 will be described.

FIGS. 10, 15, 21, and 23 show only a representative one of the main player terminals 101F and only a representative one of the sub-player terminals 101B, with the other main player terminals 101F and sub-player terminals 101B omitted.

When game start conditions are met, the main control section 301 executes a dealing card preparing process corresponding to an operation in which the dealer shuffles a pile of cards and prepares to deal the cards (step S1001). Specifically, if N cards are used for one game, numbers 1 to N are randomly imparted to the respective cards (the numbers correspond to a dealing order). The main control section 301 determines cards to be dealt to the dealer and main players in accordance with the dealing order.

Once the dealing card preparing process (step S1001) is ended, the main control section 301 transmits a main game start instruction to each main player terminal 101F (more specifically, the terminal control section 304F; hereinafter simply referred to as the "main player terminal 101F") (step S1002).

Figure 11:
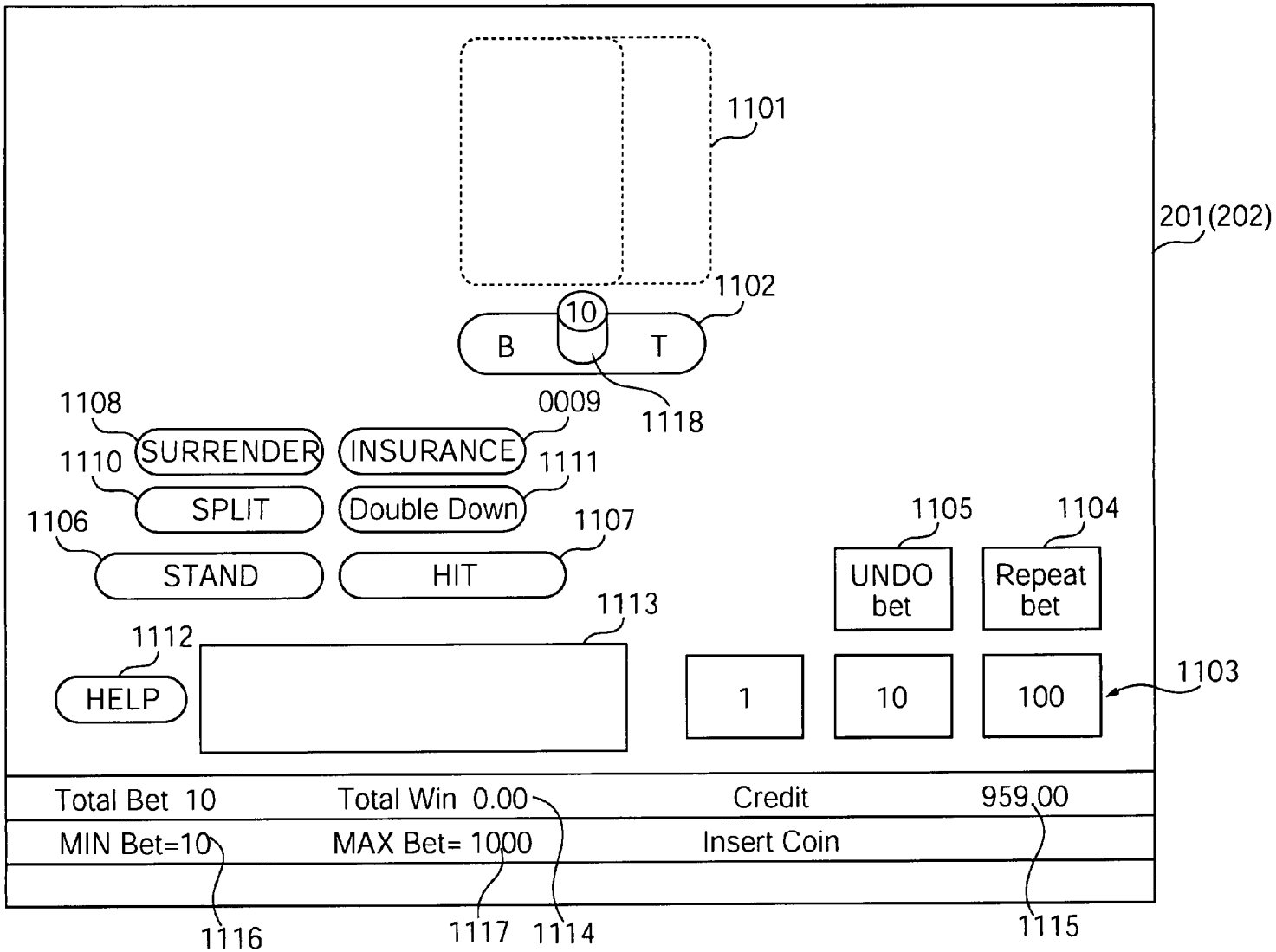
FIG. 11 is a diagram showing an exemplary screen displayed on a liquid crystal display of the main player terminal.

Upon receiving the main game start instruction, the main player terminal section 101F executes a main game input accepting process (step S1003). The main game input accepting process urges the main player to input selections or determinations (including a specified bet amount) and acquires data composed of the input contents. In this example, it first urges the main player to input a bet amount. FIG. 11 shows an exemplary screen displayed on the liquid crystal display 201 of the main player terminal section 101F as a user input interface screen when the main game input accepting process is executed. The input interface screen will be described with reference to FIG. 11.

A player card display area 1101 is provided in the front of the liquid crystal display 201 (part of the liquid crystal display 201 which is closer to the panel section 103) as shown in FIG. 11. In this case, the card image is not displayed because a process has not been executed yet which corresponds to the dealing of the cards to the main players.

A chip display area 1102 is provided below the player card display area 1101. The chip display area 1102 displays an image 1118 of chips corresponding to the number of coins bet by the main player. This provides the main players with a sense of reality to stage the game. When the player touches the chip display area 1102, the touch panel 202 determines the bet amount. The bet amount determined is then transmitted to the main control section 301. That is, the chip display area 1102 also functions as a bet determining button.

A plurality of bet buttons 1103 are displayed in the lower right of the chip display area 1102. The main player can appropriately touch any of the bet buttons 1103 to input the desired bet value. In the illustrated example, the values "1", "10" and "100" are set in the respective bet buttons 1103. The number of coins corresponding to a value set by one touch is added to the bet value.

A Repeat bet button 1104 and an UNDO bet button 1105 are displayed above the bet buttons 1103. The main player can touch the Repeat bet button 1104 to bet the number of coins bet in the last game played by that main player. On the other hand, the main player can touch the UNDO button 1105 to undo the last bet number of coins.

A group of operation buttons is displayed below and to the left of the chip display area 1102; the main players use these operation buttons to bargain with the dealer. Specifically, the operation buttons include a STAND button 1106, a HIT button 1107, a SURRENDER button 1108, an INSURANCE button 1109, a SPLIT button, and a Double Down button 1111.

The STAND button 1106 is an operation button touched to try the main player's luck with an already dealt card without requesting a new card to be dealt. The HIT button 1107 is an operation button touched by the main player to request a new card to be dealt in addition to an already dealt card. The HIT button 1107 can be consecutively used until the total number of cards is 21 or larger.

The SURRENDER button 1108 is an operation button touched to retreat from the current game. Selection of the SURRENDER button 1108 allows the dealer to collect half of the current bet amount, while returning the remaining half to the main player. The INSURANCE button 1109 is an operation button touched to purchase insurance for half the current bet amount to allow for black jack with a dealer card 801. The SURRENDER button 1108 can be used provided that the dealer's face up card (front card) is not A (ace). The INSURANCE button 1109 can be used provided that the dealer's face up card (front card) is A (ace).

The SPLIT button 1110 is an operation button touched, if two cards dealt during the game have the same number, to assign the cards to different moves. Selection of the SPLIT button 1110 enables the player to try his or her luck with the respective moves. If the same card is dealt again after the two cards have been assigned to the different moves, that card can be assigned so as to make further different moves. The SPLIT button can be used up to three times during the game. The Double Down button 1111 is an operation button touched to double the bet amount during the game. After selecting the Double Down button 1111, only one card can be picked and another picking of a card is not allowed.

A HELP button 1112 is displayed and a message area 1113 is provided, below the HIT button 1106 and STAND button 1107. The HELP button 1112 is touched to request the game (here, black jack) to be described. The message area 1113 displays a message that supports the progress of the gate as the current game status dictates. The message area 1113 also displays a message describing the game if the HELP button 1112 is selected.

An area (owned credit value display area) 1115 is provided at the lowermost area of the liquid crystal display; the area 1115 displays an area (acquired credit value display area 1114) that shows the credit value acquired by the main player and an area (owned credit value display area) 1115 that shows the credit value owned by the main player. An area (bet value lower limit value display area) 1116 and an area (bet value upper limit value display area) 1117 are also provided to display the lower and upper limit values, respectively, of the bet amount. Displaying the lower and upper limit values of the bet amount urges the main player to determine the bet amount within the range defined by these values.

When the main player operates the bet button 1103 during the display of the input interface screen, the chip image 1118 is displayed in the chip display area 1102 depending on the value corresponding to that operation. This makes it possible to check the number of coins bet by the player.

Referring back to FIG. 10, the exemplary operation of the gaming machine 100 will further be described.

The main player inputs the bet amount to the main player terminal 101F with reference to the input interface screen. Once the main player finishes inputting the value, the main player terminal 101F generates main game input contents information corresponding to the main player's input contents. The main player terminal 101F then transmits the main game input contents information to the main control section 301 (step S1004). Here, the main game input contents information includes main player terminal identification information indicating which main player terminal 101F has transmitted the information and information indicating the bet amount. The main game input contents information is transmitted to the main control section 301 by each main player terminal 101F.

Upon receiving the main game input contents information, the main control section 301 generates main game status information based on the received main game input contents information. The main control section 301 then executes a main game status information storing process of storing the main game status information (step S1005). Through this storing process, the main control section 301 records the action taken by each main player (in this example, the input bet amount).

The main control section 301 then transmits the main game status information to each sub-player terminal 101B (step S1006). The main game status information relates to the main game and includes information required for the sub-players to play the sub-game. The main control section 301 uses the main game input contents information received from each main player terminal 101F to generate main game status information. The main game status information includes, for example, the following contents.

Figure 12:
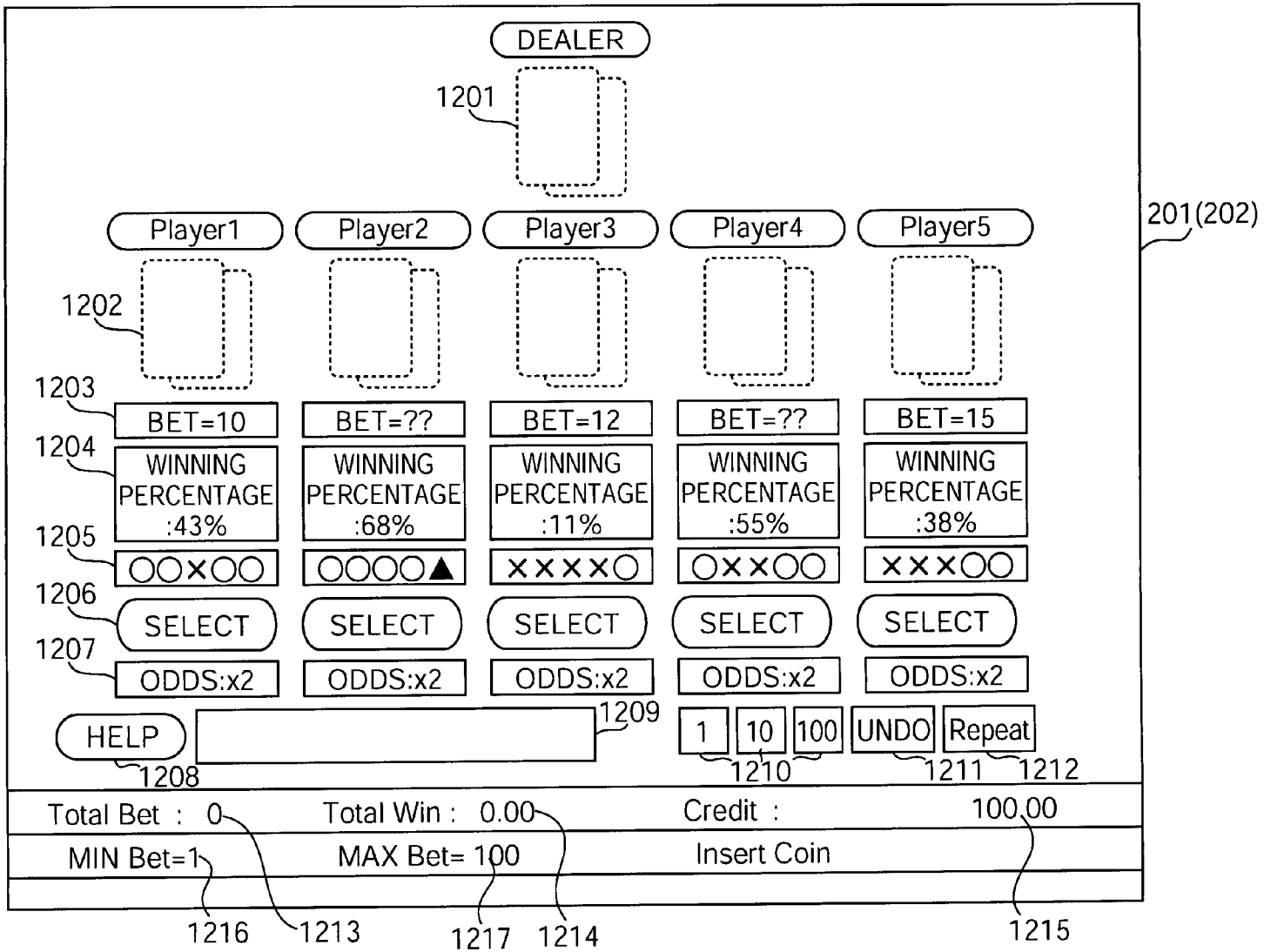
FIG. 12 is a diagram showing an exemplary screen displayed on a liquid crystal display of the sub-player terminal.

(1) Dealt cards for each main player terminal 101F
(2) Bet amount for each main player terminal 101F
(3) Winning percentage for each main player terminal 101F
(4) Win-loss history for each main player terminal 101F
(5) Cards dealt to the dealer Upon receiving the main game status information, each sub-player terminal 101B executes a main game status displaying process (step S1007). The main game status displaying process displays a main game status display screen that notices the sub-player of the game status of the main player terminals 101F. FIG. 12 shows an exemplary screen displayed on the liquid crystal display 201 of the sub-player terminal 101B during the main game status displaying process. This screen notices the sub-player of the game status of the main player terminals 101F and also functions as an input interface screen that accepts the sub-player's input for the sub-game.

This screen displays a dealer card image display area 1201 that shows an image of the cards dealt to the dealer, a main player card image display area 1202 that shows an image of the cards dealt to the main players corresponding to the respective main player terminals 101F, a bet amount display area 1203 that displays the bet amounts corresponding to playing values bet by the main players at the respective main player terminals 101F, a winning percentage display area 1204 for the main players at the respective main player terminals 101F, and a win-loss history display area 1205 that displays wins and losses in the last five games.

With reference to these displays, each sub-player predicts which main player will win the main game (will acquire a share) and bet a desired bet amount on that main player. The sub-game played by the sub-players has been described. When the sub-player touches any part of a select button area 1206, the corresponding main player is selected as the sub-player's bet target.

The select button area 1206 is provided below the win-loss history display 1205 to allow the sub-player to select any of the main players as a sub-game target. When the selected main player wins the main game, the sub-player wins the sub-game and receives a share as a reward for the win.

An odds display area 1207 is provided below the select button area 1206 to display odds (sub-game odds) by which the sub-player's bet amount is multiplied to determine the sub-player's share if the sub-player wins the sub-game. As described below, the sub-game odds may be changed as the progress of the game dictates.

As is the case with the input interface screen of the main player terminal 101F shown in FIG. 11, a plurality of bet buttons, an UNDO bet button 1211, and a Repeat bet button 1212 are provided in the lower right of the screen; the UNDO bet button 1211 is located to the right of the bet buttons 1210. A HELP button 1208 is displayed and a message area 1209 is provided, in the lower left of the screen. The lowermost area of the screen includes a bet amount display area 1213 that shows amounts bet by the sub-players, an area (acquired credit value display area 1214) that displays credit values acquired by the sub-players, and an area (owned credit value display area) 1215 that displays credit values owned by the sub-players. Further below these areas, a bet value lower limit value display area 1216 and a bet value upper limit value display area 1217 are provided; the bet value lower limit value display area 1216 displays the lower limit value of the bet amounts in the sub-game, and the bet value upper limit value display area 1217 displays the upper limit value of the bet amounts in the sub-game. Displaying the lower and upper limit values of the bet amounts urges the sub-players to determine the bet amount within the range defined by these values.

Figure 13:
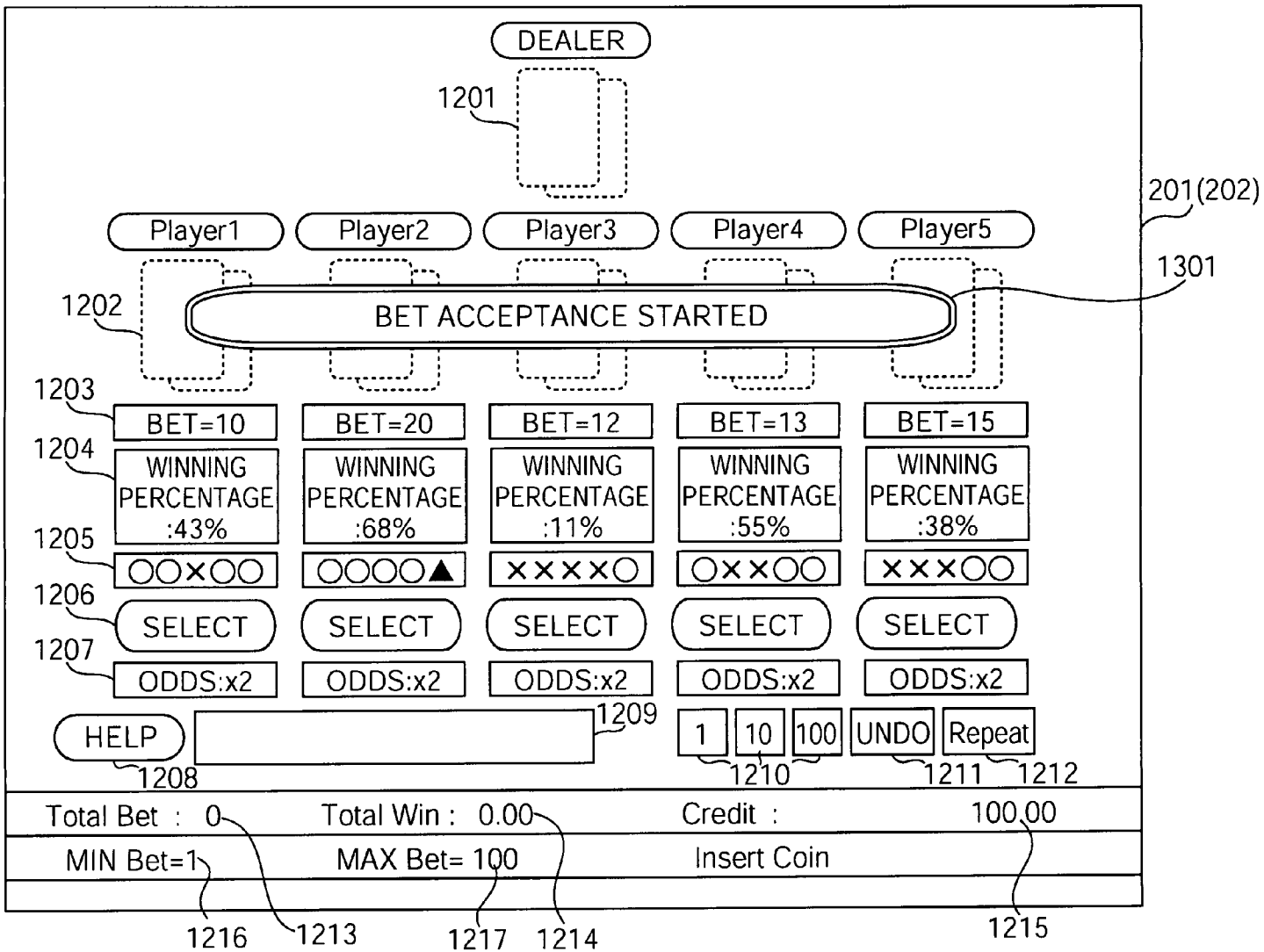
FIG. 13 is a diagram showing an exemplary screen displayed on the liquid crystal display of the sub-player terminal to which the screen in FIG. 12 changes.

After the main game status displaying process (step S1007), a process of displaying the input interface screen, the sub-player terminal 101B executes a bet acceptance start displaying process in response to reception of main game status information (step S1008). FIG. 13 shows an exemplary screen displayed on the liquid crystal display 201 of the sub-player terminal 101B during bet acceptance start display. In the screen shown in FIG. 13 is basically the same as that shown in FIG. 11 and appearing during the main game status displaying process except for the addition of a bet acceptance start message 1301. The bet acceptance start message 1301 notices the sub-player that inputs for the sub-game have been enabled.

Referring back to FIG. 10, the exemplary operation of the gaming machine 100 will further be described.

After the bet acceptance start displaying process (step S1008), the sub-player terminal 101B executes a sub-player input accepting process (step S1009). The sub-player input accepting process urges the sub-player to input a bet target selection and determinations (including a specified bet amount) for the sub-game and acquiring data composed of the input contents.

With reference to the input interface screen, the sub-player inputs a selected main player and a bet amount to the sub-player terminal 101B using the bet button 1210, UNDO bet button 1211, Repeat bet button 1212, select button area 1206, and the like.

Figure 14:
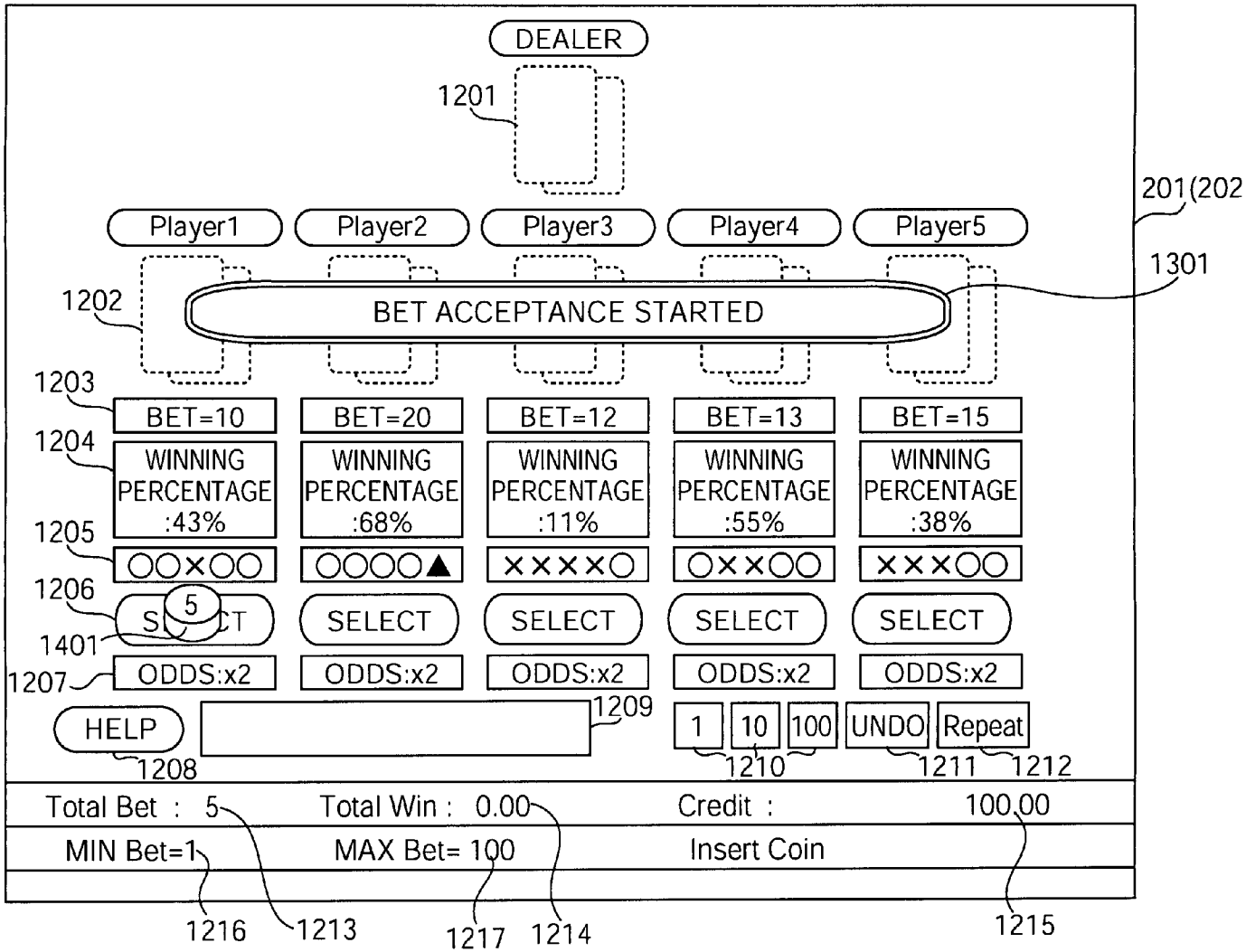
FIG. 14 is a diagram showing an exemplary screen displayed on the liquid crystal display of the sub-player terminal to which the screen in FIG. 13 changes.
Figure 15:
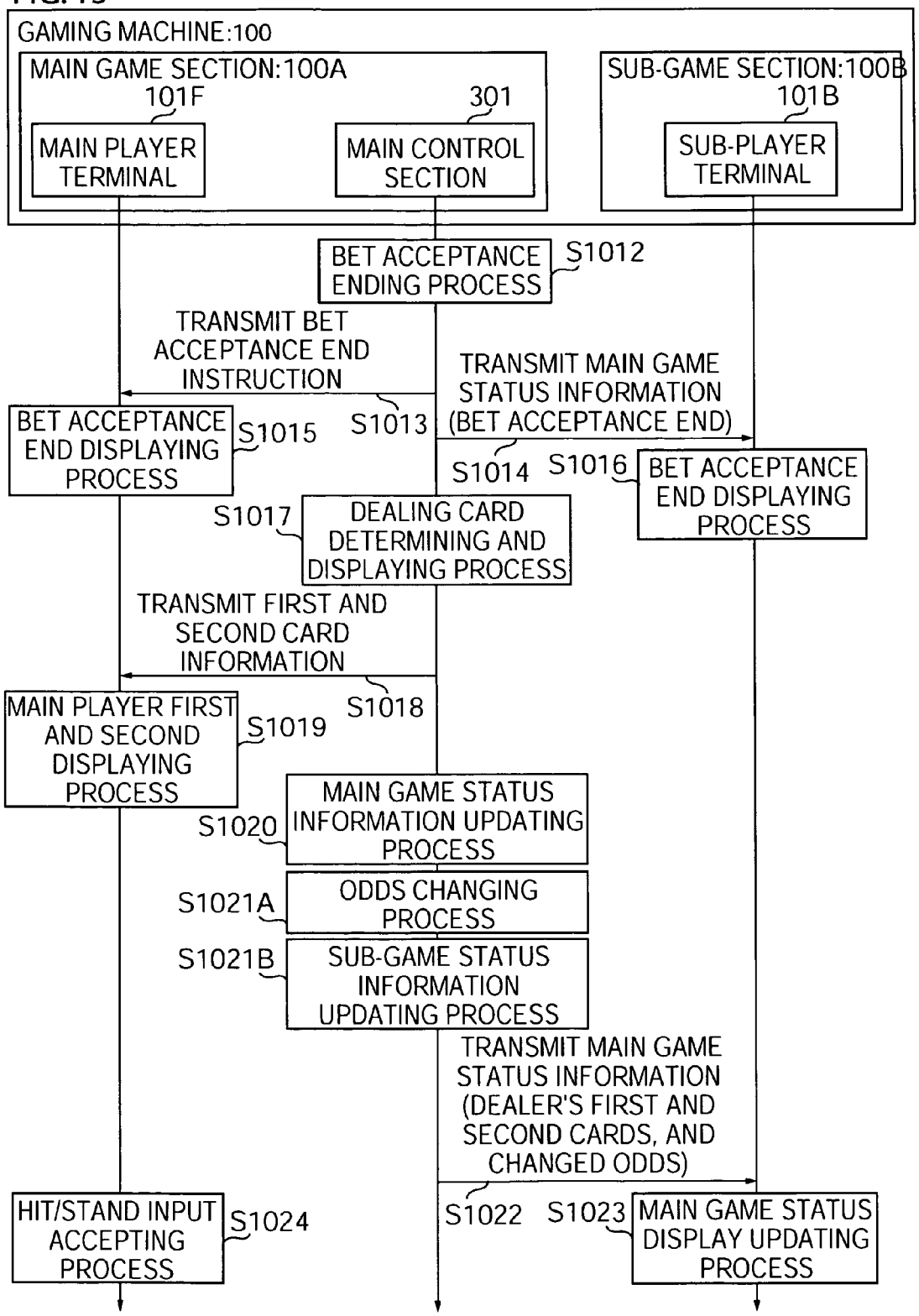
FIG. 15 is a sequence diagram showing the exemplary operation of the multi-player gaming machine and continued from the sequence diagram in FIG. 10.

FIG. 14 shows an exemplary screen displayed on the liquid crystal display 201 of the sub-player terminal 101B when the sub-player inputs a bet value during the sub-player input accepting process (step S1009).

This screen is basically the same as that shown in FIG. 13; a chip image 1401 corresponding to a bet value input provided by the sub-player is displayed in the select button area 1206. In this state, when the sub-player touches the select button area 1206, sub-game input contents information is transmitted as described below.

Referring back to FIG. 10, the exemplary operation of the gaming machine 100 will further be described.

The sub-player terminal 101B generates and transmits sub-game input contents information corresponding to contents input by the sub-player, to the main control section 301 (step S1010). The sub-game input contents information is transmitted from each sub-player terminal 101B to the main control section 301.

Upon receiving the sub-game input contents information, the main control section 301 generates sub-game status information on the basis of the received sub-game input contents information. The main control section 301 then executes a sub-game status information storing process (step S1011). Through this process, the main control section 301 records the action taken by each main player.

Now, with reference to FIG. 15, a further description will be given of the exemplary operation of the gaming machine 100 after step S1011. Once conditions for ending the acceptance of bets from the main players are met, the main control section 301 executes a bet acceptance ending process (step S1012). The conditions for ending the acceptance of the bets include, for example, the elapse of a predetermined time (for example, one minute) from the transmission of a main game start instruction.

The bet acceptance ending process (step S1012) determines whether or not the ending conditions are met and generates a bet acceptance ending instruction if the conditions are met. After the bet acceptance ending process (step S1012), the main control section 301 transmits the generated bet acceptance ending instruction to the main player terminal 101F (step S1013).

Figure 16:
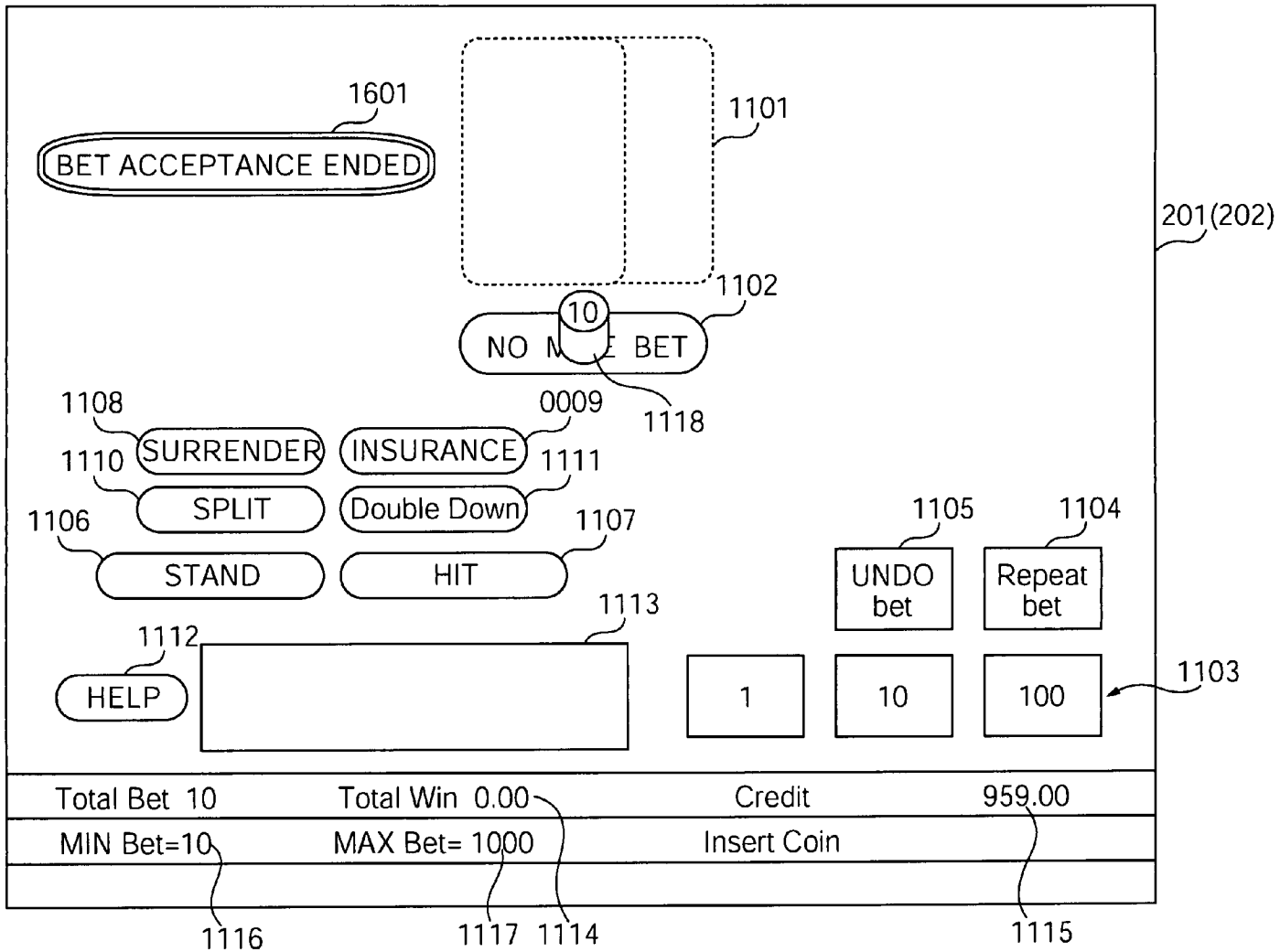
FIG. 16 is a diagram showing an exemplary screen displayed on the liquid crystal display of the main player terminal.

Upon receiving the bet acceptance ending instruction, the main player terminal 101F executes a bet acceptance end displaying process (step S1015). The bet acceptance end displaying process, for example, displays information required to show each main player that the acceptance of the bets has been ended, on the liquid crystal display 201 of the main player terminal 101F, which is an input interface screen for the main player. FIG. 16 shows an exemplary screen displayed on the liquid crystal display 201 of the main player terminal 101F after the bet acceptance end displaying process. This exemplary screen has basically the same contents as those of the exemplary screen shown in FIG. 11, described above, except that a bet acceptance end message 1601 is added to the upper left of the screen. The main player who is the operator of the main player terminal 101F determines from the bet acceptance end message 1601 that the bet acceptance has been ended.

Referring back to FIG. 15, the exemplary operation of the gaming machine 100 will further be displayed.

Simultaneously with the bet acceptance ending instruction to each main player terminal 101F, the main control section 301 transmits main game status information including a bet acceptance end message to each sub-player terminal 101B (step S1014).

Figure 17:
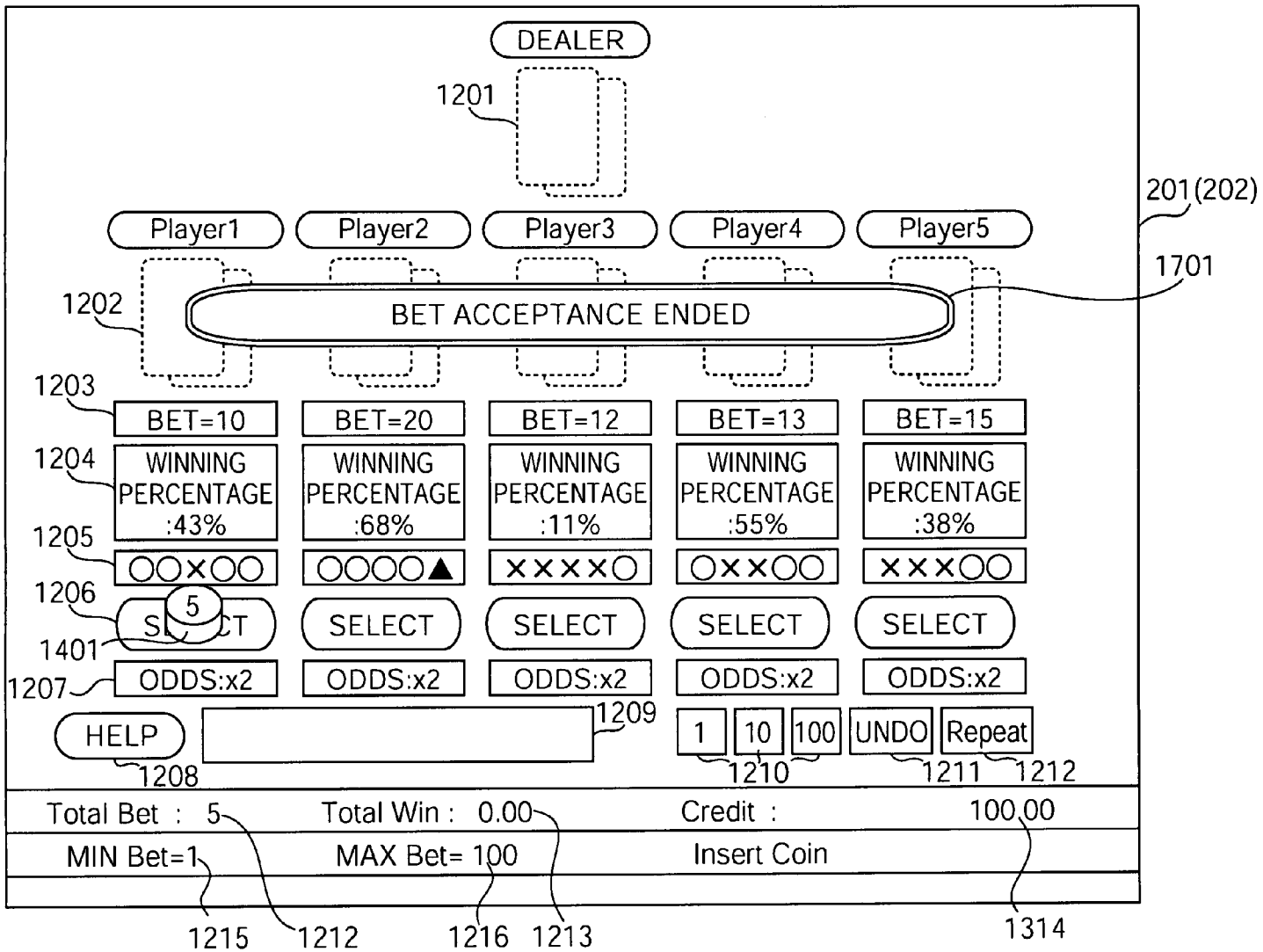
FIG. 17 is a diagram showing an exemplary screen displayed on the liquid crystal display of the sub-player terminal.

Upon receiving the main game status information, the sub-player terminal 101B executes a bet acceptance end displaying process (step S1016). The bet acceptance end displaying process, for example, displays information required to show each sub-player that the acceptance of the bets has been ended, on the liquid crystal display 201 of the sub-player terminal 101B, which is an input interface screen for the sub-player. FIG. 17 shows an exemplary screen displayed on the liquid crystal display 201 of the sub-player terminal 101B after the bet acceptance end displaying process. This exemplary screen has basically the same contents as those of the exemplary screen shown in FIG. 14, described above, except that a bet acceptance end message 1701 is displayed in place of the bet acceptance start message 1301. The sub-player who is the operator of the sub-player terminal 101B determines from the bet acceptance end message 1701 that the bet acceptance has been ended.

Referring back to FIG. 15, the exemplary operation of the gaming machine 100 will further be displayed.

The main control section 301 determines cards to be dealt to the dealer and main players and executes a dealing card determining and displaying process of displaying determined cards on the front display 104 (step S1017). The cards to be dealt are determined on the basis of the dealing order determined in the dealing card preparing process (FIG. 10, step S1001). For example, the first card to be dealt is determined to be the first card for the dealer. The second card to be dealt is determined to be the first card for the first main player. The third card to be dealt is determined to be the first card for the second main player. Similarly, two cards are determined for each of the dealer and main players in accordance with the dealing order.

Figure 18:
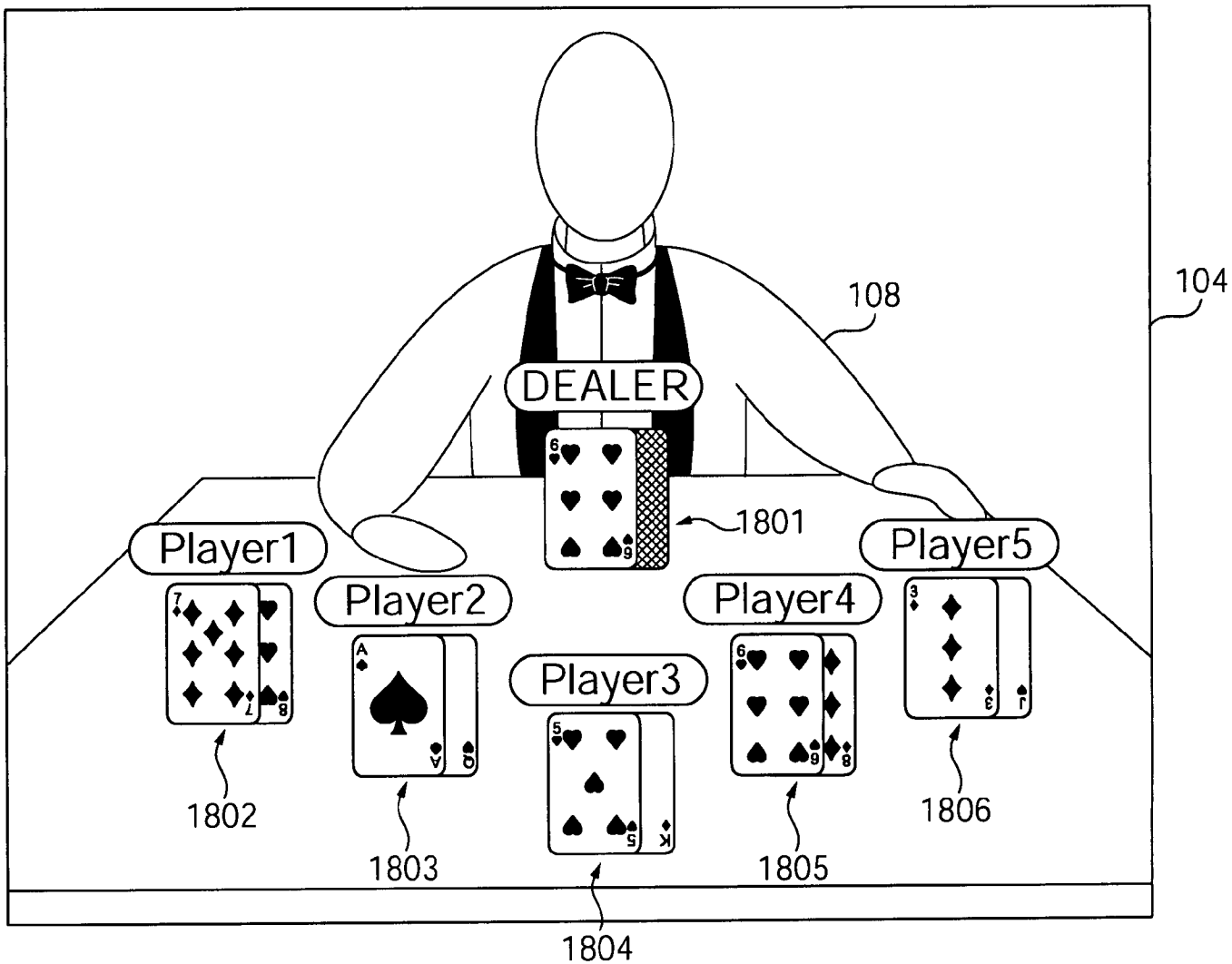
FIG. 18 is a diagram showing an exemplary screen displayed on a front display.

FIG. 18 shows an exemplary screen displayed on the front display 104 during the dealing card determining and displaying process (step S1017). The front display 104 is provided with the dealer image 108, a dealer card display area 1801 that displays an image of the cards dealt to the dealer, and main player card display areas 1802, 1803, 1804, 1805, and 1806 that display images of the cards dealt to the main players. The dealer card display area 1801 and main player card display areas 1802, 1803, 1804, 1805, and 1806 display images of front surfaces of the cards determined in accordance with the dealing order except for the dealer's second card. What cards have been dealt to the dealer and main players are thus shown to the main players, sub-players, and gallery.

Referring back to the sequence diagram in FIG. 15, the exemplary operation of the gaming machine 100 will further be described.

Once the cards to be dealt are determined by the dealing card determining and displaying process (step S1017), the main control section 301 executes a first and second card information transmission, a process of notifying the main player terminal 101F of the cards determined to be dealt to that main player terminal 101F (step S1018). For example, in the example shown in FIG. 18, the main control section 301 transmits information identifying the first card as "diamond seven" and the second card as "heart eight", as first and second card information to the main player terminal 101F for the first main player (leftmost main player shown as [Player 1] in the screen). The main control section 301 similarly transmits information identifying the first card as "spade A (ace)" and the second card as "heart Q (queen)" as first and second card information to the main player terminal 101F for the second main player (shown next to the leftmost main player in the screen as [Player 2]). The main control section 301 similarly transmits first and second card information corresponding to cards to be dealt, to the main player terminals 101F for the third to fifth main players.

Referring back to the sequence diagram in FIG. 15, the exemplary operation of the gaming machine 100 will further be described.

Upon receiving the first and second card information, each main player terminal 101F executes a main player first and second card displaying process (step S1019). This process displays a card image corresponding to the received first and second card information, in the player card display area 1101 in the liquid crystal display 201 of the main player terminal 101F.

Figure 19:
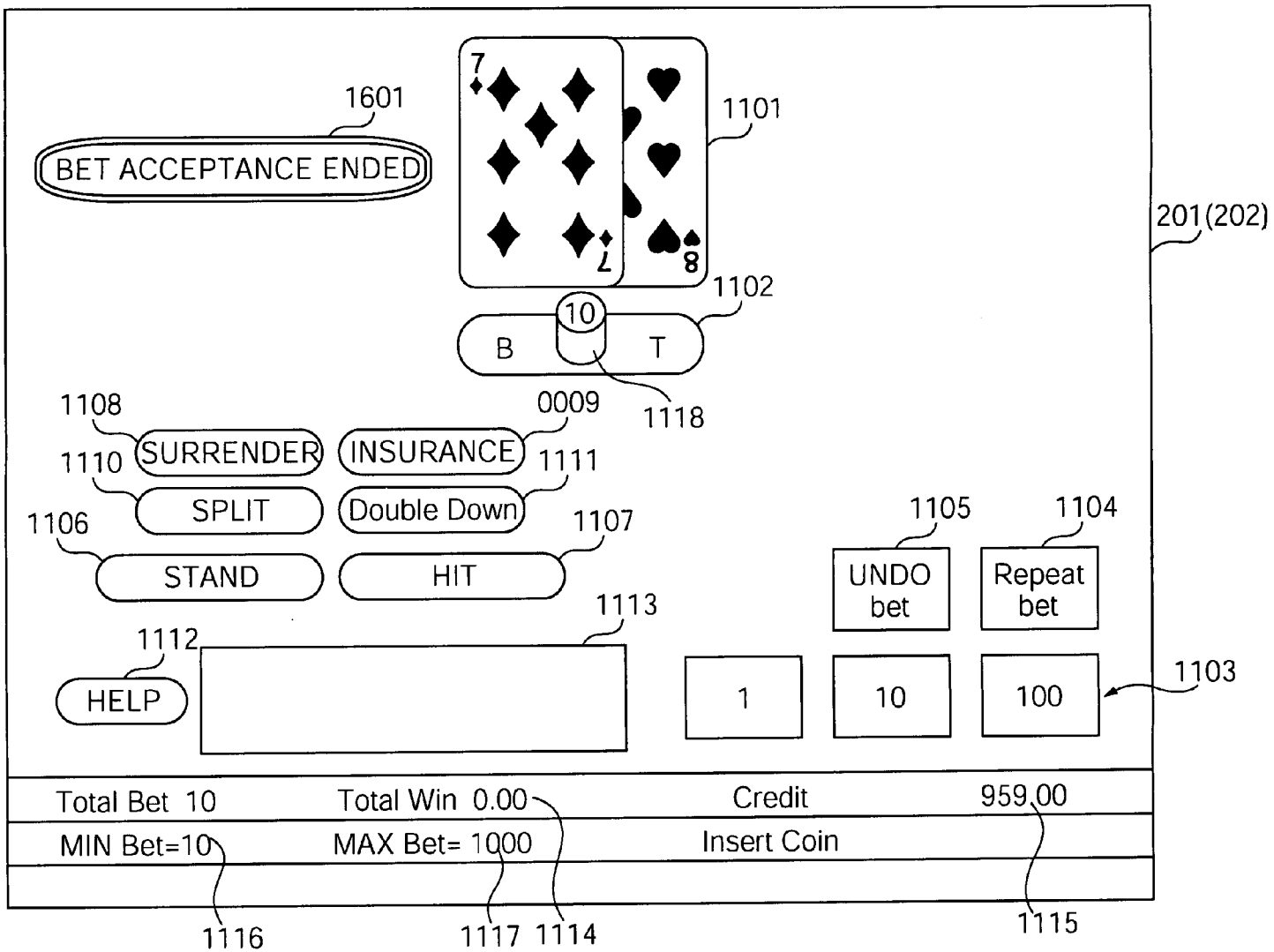
FIG. 19 is a diagram showing an exemplary screen displayed on the liquid crystal display of the main player terminal to which the screen in FIG. 16 changes.

FIG. 19 shows an exemplary screen displayed on the liquid crystal display 201 of the main player terminal 101F after the main player first and second card display process. In this example, the image display contents are basically the same as those shown in the screen shown in FIG. 16 and displayed at the end of the bet acceptance, except that a card image is shown in the player card display area 1101. In addition to the screen shown on the front display 104, the screen shown in FIG. 19 shows the main players the progress of the game.

Referring back to the sequence diagram in FIG. 15, the exemplary operation of the gaming machine 100 will further be described.

After the dealing card determining and displaying process (step S1017), the main control section 301 executes a main game status information updating process (step S1020). The above main game status information storing process (FIG. 10, step S1005) has already stored the main players' bet amounts in the memory. The game status information updating process stores the main players' first and second cards and the dealer's first and second cards, in addition to the bet amounts.

The main control section 301 subsequently executes an odds changing process of changing the odds that determine each sub-player's share (hereinafter referred to as the sub-game odds) depending on the cards of the main player bet by that sub-player (step S1021A). The odds changing process changes the sub-game odds in accordance with the progress of the main game to make the sub-game more attractive. A specific possible example of the odds changing process is a method of calculating each main player's winning probability from the dealer's first card (face up card) and the main player's first and second cards to change the odds on the basis of the winning probability. The sub-game odds prior to the odds changing process may be a predetermined default value or a value calculated on the basis of the data on the main players' bet amounts, winning percentages, and win-loss histories.

After the odds changing process (step S1021A), the main control section 301 executes a sub-game status information updating process (step 1021B). The above sub-game status information storing process (FIG. 10, step S1011) has already stored, in the memory, the main players corresponding to the respective sub-players' bet targets, and the sub-players' bet amounts and initial odds. The present sub-game status information updating process updates and stores the sub-game odds changed in the odds changing process.

The main control section 301 transmits information identifying the cards dealt to the dealer and main players and main game status information containing the changed sub-game odds, to each sub-player terminal 101B (step S1022).

Upon receiving the main game status information transmitted in step S1022, the sub-player terminal 101B executes a main game status display updating process (step S1023). The main game status display updating process updates the screen displayed on the liquid crystal display 201 of the sub-player terminal 101B, on the basis of the main game status information received in step S1022, that is, in this example, causes the dealt cards to be displayed on the liquid crystal display 201.

Figure 20:
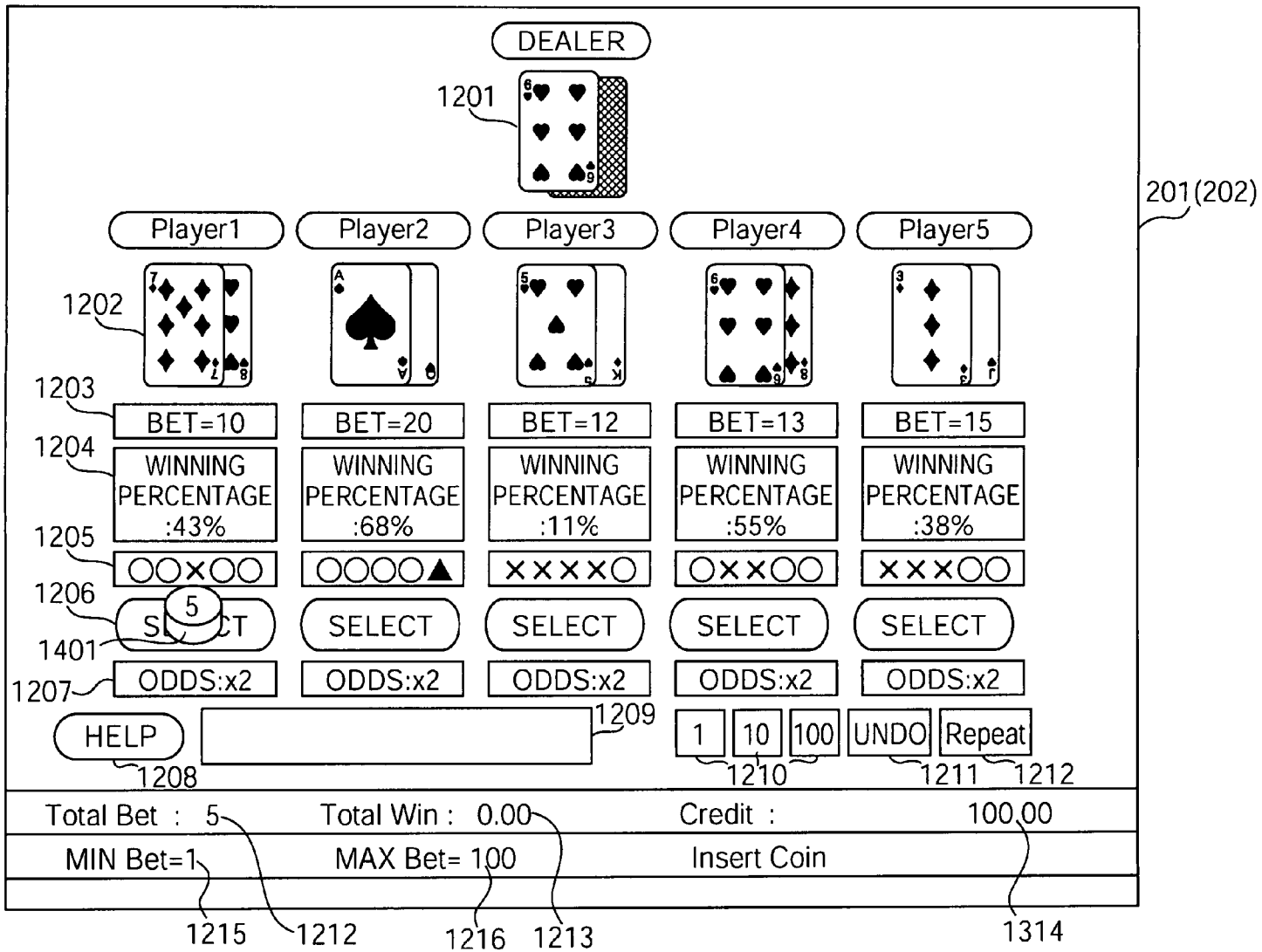
FIG. 20 is a diagram showing an exemplary screen displayed on the liquid crystal display of the sub-player terminal to which the screen in FIG. 17 changes.

FIG. 20 shows an exemplary screen displayed on the liquid crystal display 201 of the sub-player terminal 101B after the main game status display updating process (step S1023). This exemplary screen has basically the same contents as those of the exemplary screen shown in FIG. 17 (bet acceptance ending process), described above, except that images of the dealt cards are displayed in the dealer card image display area 1201 and main player card image display area 1202 on the basis of the main game status information and that the sub-game odds changed by the odds changing process are displayed in the odds display area 1207. The sub-player who is the operator of the sub-player terminal 101B can check the progress of the game on the basis of the card images displayed in the dealer card image display area 1201 and main player card image display area 1202, as well as the odds display area 1207.

Referring back to the sequence diagram in FIG. 15, the exemplary operation of the gaming machine 100 will further be described.

Upon receiving the first and second card information, the main player terminal 101F executes an input accepting process for HIT/STAND and the like, that is, a process of allowing each main player to provide an input for HIT (request for an additional card) or STAND (declaration of non-necessity of an additional card), or SURRENDER, INSURANCE, SPLIT, or Double Down, which corresponds to the next stage of the main game (step S1024). Specifically, the main player terminal 101F waits for the main player to perform an input operation with any of the operation buttons, that is, the STAND button 1106, HIT button 1107, SURRENDER button 1108, INSURANCE button 1109, SPLIT button 1110, and Double Down button 1111. If any of these buttons is operated, the main player terminal 101F executes a process corresponding to that button.

FIG. 21 is a sequence diagram showing the exemplary operation of the gaming machine 100 performed if the STAND button 1106 is operated during the HIT/STAND input accepting process (step S1024). The exemplary operation of the gaming machine 100 will be described in accordance with the sequence diagram in FIG. 21.

When the STAND button 1106 is operated to execute a STAND input (step S1025), the main player terminal 101F transmits STAND information to the main control section 301 in order to notice the main control section 301 that the main player has declared STAND (step S1026). When STAND is declared, all of the main player's action on the main player terminal 101F during the game is ended.

The main player's action is ended on all the main player terminals 101, the main control section 301 executes a main game win-or-loss determining process of determining which main player has won the main game as well as that main player's share (step S1027). This determination is made on the basis of the main game status information updated in step S1020.

After the main game win-or-loss determining process (step S1027), the main control section 301 executes a main game outcome displaying process to report the outcome to the main players, sub-players, and gallery (step S1028). The main game outcome displaying process displays the outcome of the main game on the front display 104. FIG. 22 shows an exemplary screen displayed on the front display 104 by the main game outcome displaying process. The basic screen configuration of this exemplary screen is similar to that of the exemplary screen shown in FIG. 18 except that in the dealer card display area 1801, the card image of the second card changes from a face down image to a face up image to show the dealer's total score and that the dealer's total score and a win-or-loss message 2201 are displayed on the player card display area 1801; the win-or-loss message 2201 shows whether the main player has won or lost.

The main control section 301 then transmits main game outcome information to each main player terminal 101F (step S1029). The main game outcome information indicates whether or not the main player having played on any of the main player terminals 101F has won the main game, and if this main player has won the game, further contains information on his or her share.

Upon receiving the main game outcome information, each main player terminal 101F executes a payout process on the basis of the main game outcome information (step S1030). If the main player having played on any of the main player terminals 101F has won the main game and the corresponding share information is contained in the received main game outcome information, each of the other main player terminals 101F pays the share of the main game by adding a value corresponding to the share to its credit value or driving the hopper 814 to eject coins the number of which corresponds to the share.

The main control section 301 executes a sub-game win-or-loss determining process of determining which sub-player has won the sub-game as well as that sub-player's share (step S1031). This determination is made on the basis of the sub-game status information updated in step S1021B and the determination in the main game win-or-loss determining process (step S1027).

The main control section 301 transmits sub-game output information to each sub-player terminal 101B (step S1032). The sub-game outcome information is based on the determination in the sub-game win-or-loss determining process. The sub-game outcome information indicates whether or not the sub-player having played on any of the sub-player terminals 101B has won the game, and if this sub-player has won the game, further contains information on his or her share.

Upon receiving the sub-game outcome information, each sub-player terminal 101B executes a payout process on the basis of the sub-game outcome information (step S1033). If the sub-player having played on any of the sub-player terminals 101B has won the main game and the corresponding share information is contained in the received sub-game outcome information, each of the other sub-player terminals 101B pays the share of the sub-game by adding a value corresponding to the share to its credit value or driving the hopper 814 to eject coins the number of which corresponds to the share.

With reference to FIG. 23, description will be given of the exemplary operation of the gaming machine 100 performed if the HIT button 1107 is operated in the HIT/STAND input accepting process (FIG. 15; step S1024). FIG. 23 is a sequence diagram showing the exemplary operation of the gaming machine 100 performed if the HIT button 1107 is operated.

When the HIT button 1106 is operated to execute a HIT input (step S1034), the main player terminal 101F transmits HIT information to the main control section 301 to notice the main control section 301 that the main player has declared HIT (step S1035).

Upon receiving the HIT information, the main control section 301 executes a dealing card determining and displaying process of determining a card to be dealt to the main player who has declared HIT and displaying the determined card on the front display 104 (step S1036). The card to be dealt is determined on the basis of the dealing order determined in the dealing card preparing process (FIG. 10, step S1001). If the 1st to 12th dealing cards have already been dealt, the 13th dealing card is determined to be the third card for the main player who has declared HIT.

Figure 24:
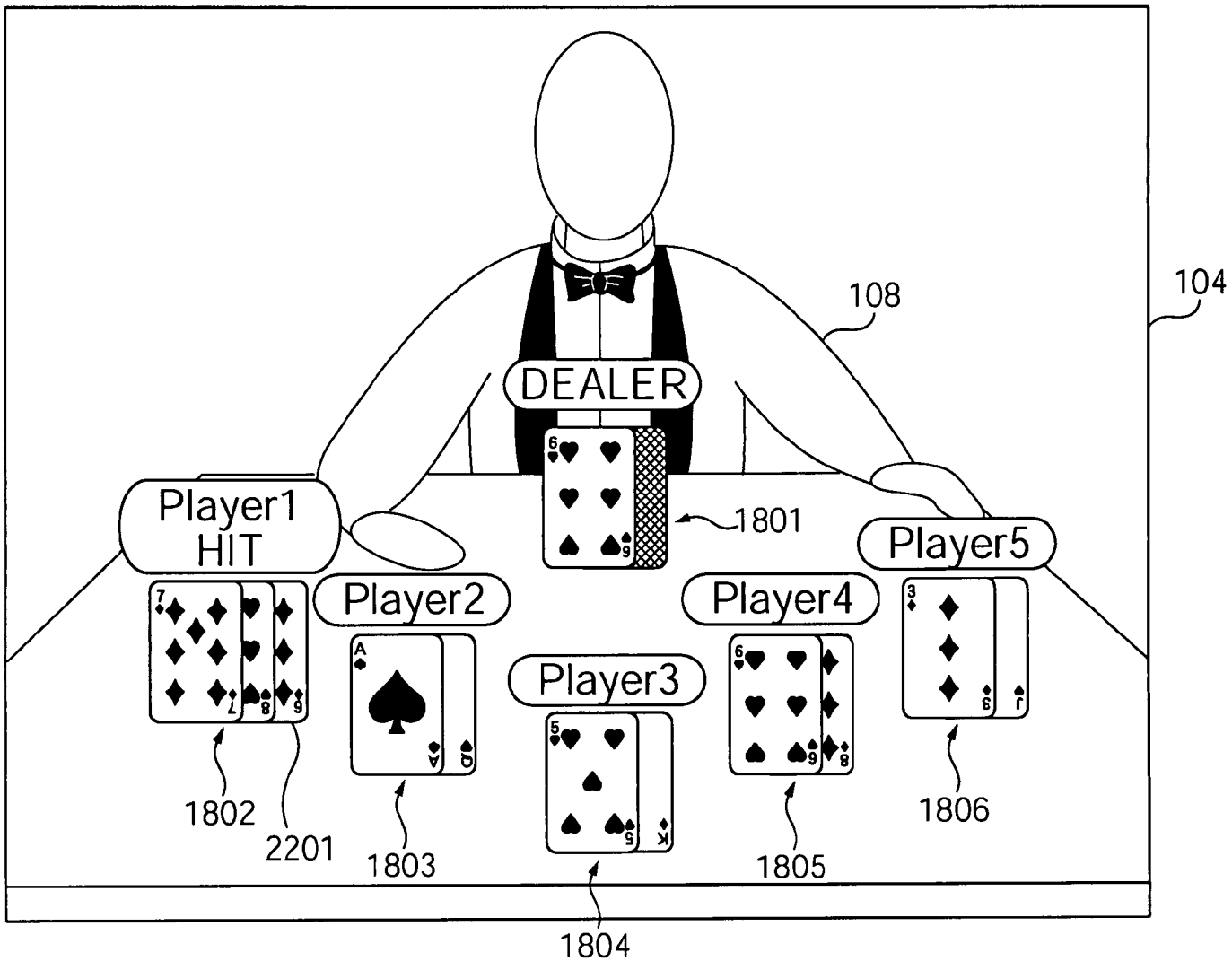
FIG. 24 is a diagram showing an exemplary screen displayed on the front display.

FIG. 24 shows an exemplary screen displayed on the front display 104 during the dealing card determining and displaying process (step S1036). An image displayed on the front display 104 is almost similar to that displayed in the exemplary screen (FIG. 18) for the dealing card determining and displaying process (FIG. 15, step S1017). A card image 2201 corresponding to the third card is additionally displayed in the main player card display area 1802 corresponding to the main player who has declared HIT (in this example, the first main player).

Referring back to FIG. 23, the exemplary operation of the gaming machine 100 will be described in accordance with the sequence diagram.

Once the card to be dealt is determined by the dealing card determining and displaying process (step S1035), the main control section 301 executes a third card information transmission that is a process of notifying the main player terminal 101F having transmitted the HIT information of the card determined to be the third card for that main player terminal 101F (step S1037). For example, in the example shown in FIG. 24, the main control section 301 transmits information identifying the third card as "diamond 6", as third card information to the main player terminal 101F for the first game player (leftmost player shown as [Player 1] in the figure).

Figure 25:
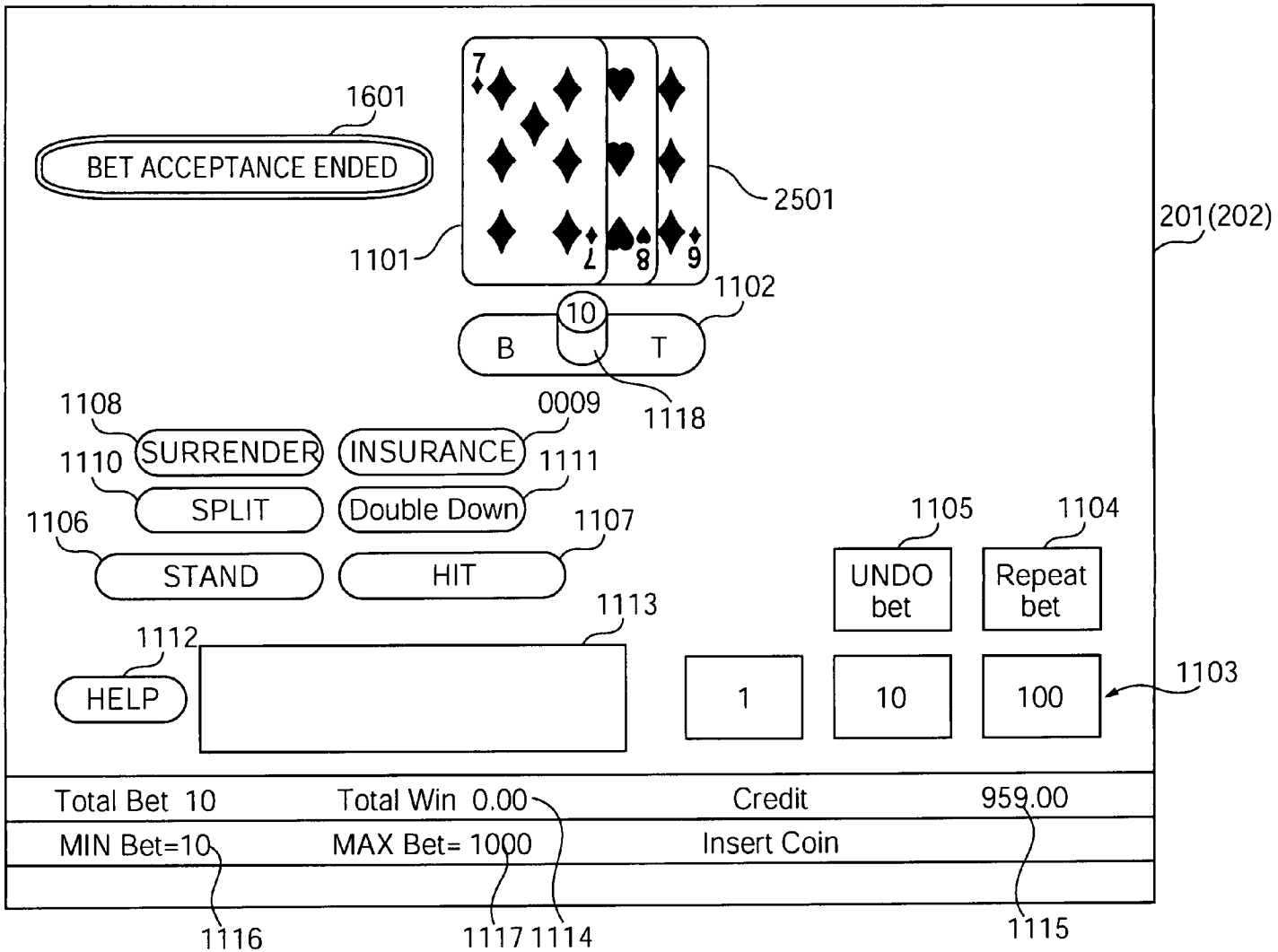
FIG. 25 is a diagram showing an exemplary screen displayed on the liquid crystal display of the main player terminal.

Upon receiving the third card information, the main player terminal 101F executes a main player third card displaying process (step S1038). This process displays a card image corresponding to the received third card information in the player card display area 1101 of the liquid crystal display 201 of the main player terminal 101F. FIG. 25 is an exemplary screen displayed on the liquid crystal display 201 of the main player terminal 101F after the main player third card displaying process. The image display contents in this example are basically the same as those in the screen displayed after the main player first and second card displaying process (FIG. 15, step S1019), shown in FIG. 19, described above, except that a third card image 2501 is additionally displayed in the player card display area 1101. The main player can determine the progress of the game on the basis of the screen shown in FIG. 25 in addition to the screen displayed on the front display 104.

Referring back to FIG. 23, the exemplary operation of the gaming machine 100 will be described in accordance with the sequence diagram.

After the above dealing card determining and displaying process (step S1036), the main control section 301 executes a main game status information updating process (step S1039). The above main game status information updating process (FIG. 15, step S1020) has already stored the main players' bet amounts and first and second cards in the memory. The present main game status information updating process stores the third card dealt to the main player who has declared HIT.

The main control section 301 subsequently executes an odds changing process of changing the sub-game odds in response to generation of the third card (step S1040). The odds changing process in this case is executed only on the sub-players having selected the main player having declared HIT as their bet target.

After the odds changing process (step S1040), the main control section 301 executes a sub-game status information updating process (step S1041). The above sub-game status information updating process (FIG. 15, step S1021B) has already stored, in the memory, the main players corresponding to the respective sub-players' bet targets, and the sub-players' bet amounts and initial odds (changed odds if the initial odds are changed in step S1021A). The present sub-game status information updating process reflects the sub-game odds changed in the odds changing process in step S1040, in the sub-game status information to update and store the sub-game odds.

The main control section 301 transmits information identifying the third card dealt to the main player and information containing the changed sub-game odds, that is, the main game status information, to each sub-player terminal 101B (step S1042).

Upon receiving the main game status information transmitted in step S1042, the sub-player terminal 101B executes a main game status display updating process (step S1043). The main game status display updating process updates the screen displayed on the liquid crystal display 201 of the sub-player terminal 101B on the basis of the received main game status information. In other words, in this example, the main game status display updating process causes the third card dealt to the main player who has declared HIT to be additionally displayed on the liquid crystal display 201.

Figure 26:
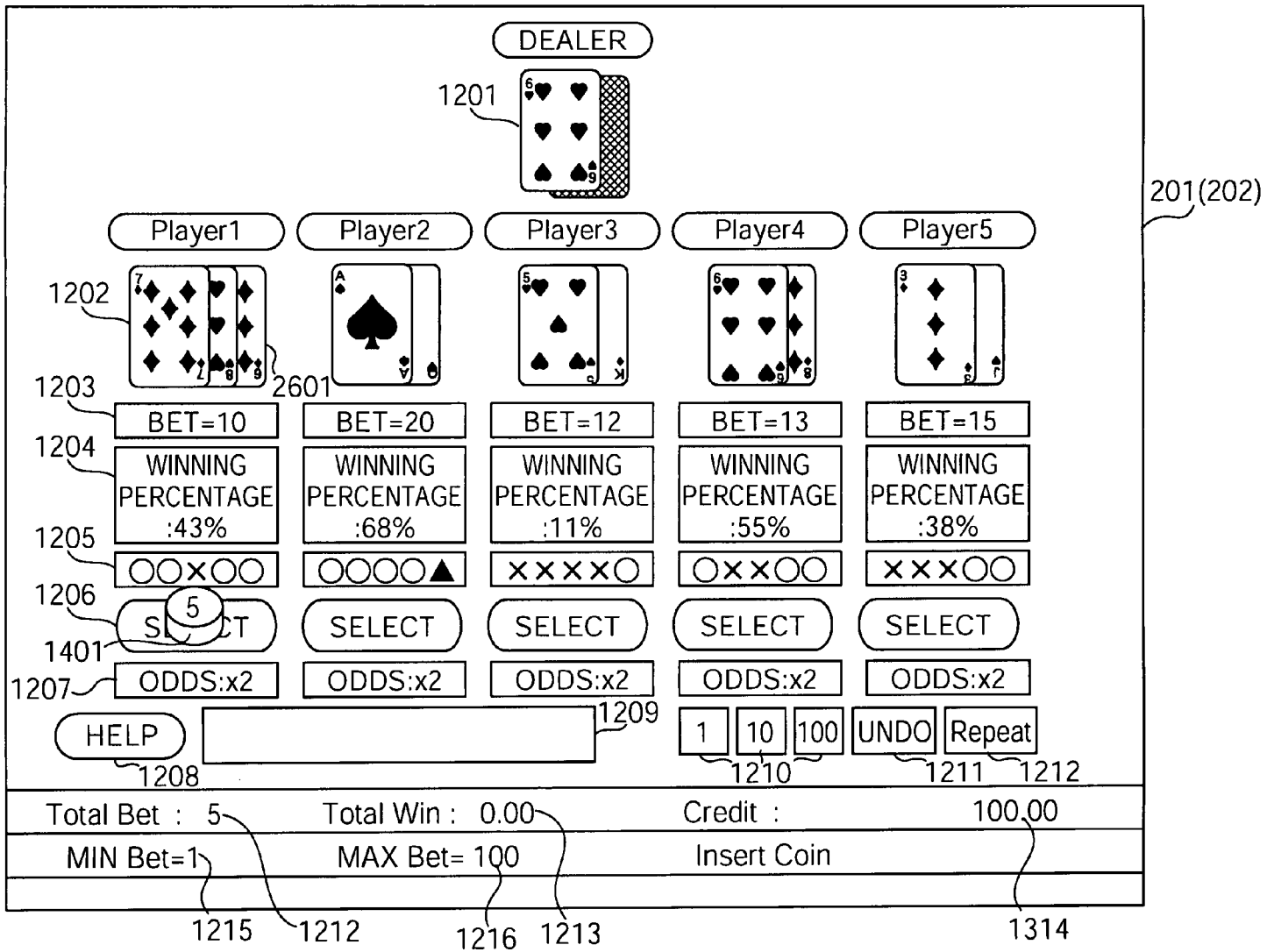
FIG. 26 is a diagram showing an exemplary screen displayed on the liquid crystal display of the sub-player terminal.

FIG. 26 shows an exemplary screen displayed on the liquid crystal display 201 of each sub-player terminal 101B after the main game status display updating process (step S1043). The exemplary screen has basically the same contents as those of the exemplary screen shown in FIG. 20, described above (main game status display updating process; see FIG. 15, step S1023) except that a card image 2601 of the third card is additionally displayed in the main player card image display area 1202 corresponding to the first main player and that the numerical value shown in the odds display area 1207 has been changed. The sub-player who is the operator of the sub-player terminal 101B can check the progress of the game on the basis of the card image displayed in the main player card image display area 1202 and the changed display of the odds display area 1207.

After step S1043, the processing by the gaming machine 100 returns to the HIT/STAND input accepting process (FIG. 15; step S1024). Similar processes are then repeated until all the main player terminals 101F transmit notices of the end of action (declaration of STAND or SURRENDER) to the main control section 301.

The gaming machine operating as described above enables players waiting for players now playing a game to end it, to enjoy a sub-game during waiting.

[6. Other Embodiments]

The above embodiment may be varied as described below.

(1) In the above embodiment, the bet acceptance end message 1701 (see FIG. 17) on the sub-player terminal 101B is based on the bet acceptance end instruction (FIG. 15, step S1013) from the main control section 301. However, the main game status information (see FIG. 10, step S1006), indicating the main players' bet amounts, may contain the bet acceptance end time of the sub-game and the period allowed before the bet acceptance is ended (for example, 90 seconds after the reception of the main game status information). The sub-player terminal 101B may then determine whether or not the bet acceptance end time has come, on the basis of the main game status information. If the sub-player terminal 101B determines that the bet acceptance end time has come, it may execute the bet acceptance end displaying process (FIG. 15, step S1016). This variation enables bets from the sub-players to be accepted for a predetermined time after the betting at the main game has been ended. The sub-players can thus confirm the main players' bet amounts before determining their bets for the sub-game.

(2) In the above embodiment, each sub-player's share is determined depending on his or her bet amount and share odds independently of the outcome of the main game for the main player who is the sub-player's bet target. However, the present invention may be established when the sub-player's share is determined on the basis of the outcome (bet amount, share odds) of the game for the main player selected as the sub-player's bet target.

This variation allows the sub-players' awards to be determined depending on the progress of the game for the main players. The sub-players are thus attracted to the main game, with their motivations to play the game enhanced.

(3) In the above embodiment, the sub-player can determine his or her bet amount at his or her discretion. However, the present invention may be established when the sub-player's bet amount is automatically determined depending on the bet amount of the main player corresponding to that sub-player's bet target. For example, if the bet amount of the main player corresponding to the sub-player's bet target is 10 credits, the sub-player having selected that main player is automatically determined to be 10 credits. Alternatively, the sub-player may play the game only if he or she bets 10 credits.

This variation allows the sub-player's share to be determined depending on the progress of the game for the main players. This enables the sub-players to be attracted to the main game, with their motivations to play the game enhanced.

(4) In the description of the above embodiment, the main control section 301 and the main player terminals 101F are separately provided in the main game section 100A. However, the present invention is not limited to this configuration. For example, the main control section 301 need not be provided in the main game section 100A. Instead, a program operating as the main control section 301 may be mounted in the terminal control section 304F of any of the main player terminals 101F so that this terminal control section 304F can function as a host for the other main player terminals 101F and sub-player terminals 101B. In other words, the present invention may be established when any of the main player terminals 101F is configured to also operate as the main control section 301.

The present invention enables even players or clients who are not allowed to play the first game owing to the limitation on the number of players to wait to be allowed to play the first game while enjoying the progress and outcome of the first game.

Additional advantages and modifications will readily occur to those skilled in the art. Therefore, the invention in its broader aspects is not limited to the specific details or representative embodiments shown and described herein. Accordingly, various modification may be made without departing from the spirit or scope of the general inventive concept as defined by the appended claims and their equivalents.

What is claimed is:

1. A multi-player gaming machine comprising:

a first game terminal operated by a plurality of first game players so as to execute a first game; and a second game terminal operated by at least one second game player not participating in the first game, so as to execute a second game which is different from the first game, wherein:

the first game is executed by betting playing values by the plurality of first game players within a bet acceptance period of the first game, and by paying out awards based on a first bet amount to the first game players in accordance with an outcome of the first game;

the second game is executed by betting playing values by the at least one second game player on an award status of the first game executed by the first game players participating in the first game, within a bet acceptance period of the second game, and by paying out awards based on a second bet amount to the at least one second game player in accordance with the outcome of the first game;

the first game terminal sends the second game terminal first game status information indicating a status of the first game within the bet acceptance period of the first game; and the second game terminal determines the bet acceptance period of the second game based on the first game status information received from the first game terminal so as to associate the bet acceptance period of the second game with the bet acceptance period of the first game, and wherein odds for determining the awards of the second game on the basis of the playing values bet vary according to the first game status information.

2. The multi-player gaming machine according to claim 1, wherein the first game status information contains at least one of a bet acceptance end time of the second game and a period allowed before the bet acceptance is ended.

3. The multi-player gaming machine according to claim 1, wherein the awards for the second game players are determined on the basis of the outcomes of the first game for the first game players selected by the second game players as the bet targets.

4. The multi-player gaming machine according to claim 1, wherein the second game players' bet amounts are determined depending on the bet amount of the first game players selected by the second game players as the player's bet targets.

5. The multi-player gaming machine according to claim 1, wherein the first game status information contains information indicating a bet acceptance end time of the first game, and the second game terminal determines the bet acceptance period of the second game on the basis of the information indicating the bet acceptance end time.

6. The multi-player gaming machine according to claim 5, wherein the first game status information contains at least one of a bet acceptance end time of the second game and a period allowed before the bet acceptance is ended.

7. The multi-player gaming machine according to claim 5, wherein the awards for the second game players are determined on the basis of the outcomes of the first game for the first game players selected by the second game players as the bet targets.

8. The multi-player gaming machine according to claim 5, wherein the second game players' bet amounts are determined depending on the bet amount of the first game players selected by the second game players as the player's bet targets.

9. The multi-player gaming machine according to claim 1, wherein the first game status information contains information indicating a game start time of the first game, and the second game terminal determines the bet acceptance period of the second game on the basis of the information indicating the bet acceptance start time.

10. The multi-player gaming machine according to claim 9, wherein the odds for determining the awards of the second game on the basis of the playing values bet vary according to the first game status information.

11. The multi-player gaming machine according to claim 9, wherein the first game status information contains at least one of a bet acceptance end time of the second game and a period allowed before the bet acceptance is ended.

12. The multi-player gaming machine according to claim 9, wherein the awards for the second game players are determined on the basis of the outcomes of the first game for the first game players selected by the second game players as the bet targets.

13. The multi-player gaming machine according to claim 9, wherein the second game players' bet amounts are determined depending on the bet amount of the first game players selected by the second game players as the player's bet targets.

14. A method for executing a multi-player game including a first game executed with a first game terminal operated by a plurality of first game players and a second game which is different from the first game, the second game executed with a second game terminal operated by at least one second game player not participating in the first game, the first game being executed by betting playing values by the plurality of first game players within a bet acceptance period of the first game, and by paying out awards based on a first bet amount to the first game players in accordance with an outcome of the game, the second game being executed by betting playing values by the at least one second game player on an award status of the first game executed by the first game players participating in the first game, within a bet acceptance period of the second game, and by paying out awards based on a second bet amount to the at least one second game player in accordance with the outcome of the first game, the method comprising the steps of:

providing the second game terminal, through the first game terminal, with first game status information indicating a status of the first game within the bet acceptance period of the first game;

determining through the second game terminal, the bet acceptance period of the second game based on the first game status information provided by the first game terminal so as to associate the bet acceptance period of the second game with the bet acceptance period of the first game;

paying out, through the first game terminal, the awards based on the bet amount, to the first game players in accordance with the outcome of the first game; and paying out, through the second game terminal, the awards based on the bet amount, to the at least one second game player in accordance with the outcome of the first game, wherein odds for determining the awards of the second name on the basis of the playing values bet vary according to the first game status information.

15. The method according to claim 14, wherein the first game status information contains at least one of a bet acceptance end time of the second game and a period allowed before the bet acceptance is ended.

16. The method according to claim 14, wherein the awards for the second game players are determined on the basis of the outcomes of the first game for the first game players selected by the second game players as the bet targets.

17. The method according to claim 14, wherein the second game players' bet amounts are determined depending on the bet amount of the first game players selected by the second game players as the player's bet targets.

18. The method according to claim 14, wherein the first game status information contains information indicating a bet acceptance end time of the first game, and the second game terminal determines the bet acceptance period of the second game on the basis of the information indicating the bet acceptance end time.

19. The method according to claim 14, wherein the first game status information contains information indicating a game start time of the first game, and the second game terminal determines the bet acceptance period of the second game on the basis of the information indicating the bet acceptance start time.

20. A multi-player gaming machine comprising:

a plurality of first game terminals operated by a plurality of first game players so as to execute a first game, the plurality of the first game players being limited to a predetermined number; and a plurality of second game terminals operated by at least one second game player ineligible to participate in the first game performed at the first game terminals so as to execute a second game which is different from the first game, wherein:

the first game is executed by betting playing values by the plurality of first game players within a bet acceptance period of the first game, and by paying out awards based on the betted playing values to the first game players in accordance with an outcome of the first game;

the second game is executed by betting playing values by the second game players on an award status of the first game executed by the first game players participating in the first game, within a bet acceptance period of the second game, and by paying out awards based on the betted playing values to the second game players in accordance with the outcome of the second game that is different from the outcome of the first game;

the first game terminal sends the second game terminal, first game status information indicating a status of the first game within the bet acceptance period of the first game;

the second game terminal determines the bet acceptance period of the second game based on the first game status information received from the first game terminal so as to associate the bet acceptance period of the second game with the bet acceptance period of the first game;

the first game terminal gives awards to the first game player participating in the first game, based on the outcome of the first game and the betted playing values in the bet acceptance period of the first game; and the second game terminal gives awards to the second game players participating in the second game that is different from the first game, based on the outcome of the second game that is different from the outcome of the first game and the betted playing values in the bet acceptance period of the second game.

* * * * *